US005078383A

United States Patent [19]

Shiina et al.

[11] Patent Number: 5,078,383

[45] Date of Patent: Jan. 7, 1992

[54] PAPER ACCOMMODATION APPARATUS

[75] Inventors: Toshihito Shiina; Misao Kobayashi; Masao Shimizu; Hidenobu Sugano, all of Kofu, Japan

[73] Assignees: Sharp Kabushiki Kaisha, Osaka; Nippon Seimitsu Kogyo Kabushiki Kaisha, Kofu, both of Japan

[21] Appl. No.: 467,210

[22] Filed: Jan. 19, 1990

[30] Foreign Application Priority Data

Jan. 21, 1989 [JP] Japan ..... 1-12872

[51] Int. Cl.[5] ..... B65H 31/08

[52] U.S. Cl. ..... 271/212

[58] Field of Search ..... 271/209, 212, 220, 177, 271/3.1, 223, 224; 414/794.9, 795, 795.2, 795.3

[56] References Cited

U.S. PATENT DOCUMENTS 643,624 2/1900 Berry ..... 271/212 X
4,413,901 11/1983 Kollar ..... 271/3.1
4,456,235 6/1984 Colglazier et al. ..... 271/212 X

FOREIGN PATENT DOCUMENTS 235248 9/1988 Japan .

*Primary Examiner*—David H. Bollinger

[57] ABSTRACT

A paper accommodation apparatus for use, for example, in copying machine includes a recirculating document feeder. The feeder includes a paper stacker for stacks of papers to be copied. After each sheet of paper is copied, it is returned to the stack. A sheet after copying is moved in a first direction back into the paper stacker. An apparatus is provided for moving an end portion of the paper after it is in the paper stacker, in an opposite direction to the first direction to lift the paper so that the end of the paper can rest on a guide.

4 Claims, 21 Drawing Sheets 31
91
11
32
93
92
94
95

PAPER ACCOMMODATION APPARATUS

BACKGROUND OF THE INVENTION

1. Field of the Invention

The present invention relates to a paper accommodation apparatus for use in an image formation apparatus such as a copying machine. More particularly, it relates to a paper accommodation apparatus at the recycle system automatic original feed apparatus, which successively feeds thereto originals accommodated in a paper stacker from the uppermost one of them and returns the original, which has been circulated to an exposure unit or the like, to the paper stacker through a lower return inlet.

2. Description of the Prior Art

Generally, a paper accommodation apparatus used in image formation apparatuses such as copying machines, separates one by one the originals loaded and set on the paper stacker. The apparatus then transports each one to a predetermined exposure unit, returns the original to the paper stacker after exposure, and transports the next original from the paper stacker to the exposure unit. Such a cycle is sequentially repeated. Thus, when the loaded originals have been once circularly transported to the exposure unit, one set of copies of the entire loaded originals are obtained. Further, when the above-mentioned circular transportation is repeated, a predetermined number of times, a predetermined set of copies are obtained.

In such a case, the originals loaded on the paper stacker are fed from the upper portion of the paper stacker to an exposure unit and after being circulated, are returned from a lower return inlet positioned below the paper stacker to the inside of the paper stacker, so that a recycle system automatic original feed apparatus that operates at high speed can be easily obtained.

In the above-mentioned case, however, the original after being circulated to the exposure unit or the like, must be returned below the loaded originals in the paper stacker through the lower return inlet. This causes jams and damages when the originals are circulated at high speed.

Moreover, to transport the originals at high speed, a high accuracy is required to separate and transport the originals without an occurrence of jams or damages.

SUMMARY OF THE INVENTION

The paper accommodation apparatus of this invention, overcomes the above-discussed and numerous other disadvantages and deficiencies of the prior art. The apparatus comprises a paper stacker that has a first and second end in which papers are accommodated: reference stoppers that are disposed at the first end of said paper stacker; a lower return inlet that is disposed at the second end of said paper stacker, said lower return inlet being provided with a paper discharge means; a paper discharge guide that is disposed at a position spaced from said reference stoppers at a distance smaller than the size of the papers to thereby hold above said lower return inlet the rear end of paper that has been discharged from said lower return inlet into said paper stacker by means of said paper discharge means; a delivery means by which the paper discharged from said lower return inlet to said paper stacker by means of said paper discharge means is deflected so as to be fed into said paper stacker beyond said paper discharge guide even after the fore end of the paper has come into contact with said reference stoppers; and a kick-up means by which the rear end of the paper, the fore end of which has been restricted by said reference stoppers, is kicked up to be moved in the opposite direction to that of the paper delivery by the delivery means and held on said paper discharge guide.

In a preferred embodiment, the delivery means is a semicircular roller that is projectable and retractable from the bottom surface area of said paper stacker in the vicinity of said reference stoppers.

In a preferred embodiment, the paper discharge means provided at said lower return inlet functions as said delivery means.

In a preferred embodiment, the kick-up means is a kick-up lever that is driven in synchronism with said delivery means and is projectable and retractable from the bottom surface of said paper stacker.

In a preferred embodiment, the paper discharge means is a paper discharge roller and said paper discharge guide is an elastic piece that is in contact with said discharge roller, said elastic piece contacting said discharge roller at the paper discharge guide side before a point at which said paper discharge guide is tangent to said paper discharge roller.

Thus, the invention described herein makes possible the objectives of (1) providing a paper accommodation apparatus that operates at high speed and has no problem that the original becomes jammed or damaged; (2) providing a paper accommodation apparatus that circulates the original at high speed without an occurrence of jams and damages; and (3) providing a paper accommodation apparatus that reliably returns the original, which has been circulated to the exposure unit or the like, to the lowermost portion of the remaining originals accommodated in the paper stacker via a lower return inlet positioned at a lower portion of the paper stacker.

BRIEF DESCRIPTION OF THE DRAWINGS

This invention may be better understood and its numerous objects and advantages will become apparent to those skilled in the art by reference to the accompanying drawings as follows.

DESCRIPTION OF THE PREFERRED EMBODIMENTS

Figure 1:
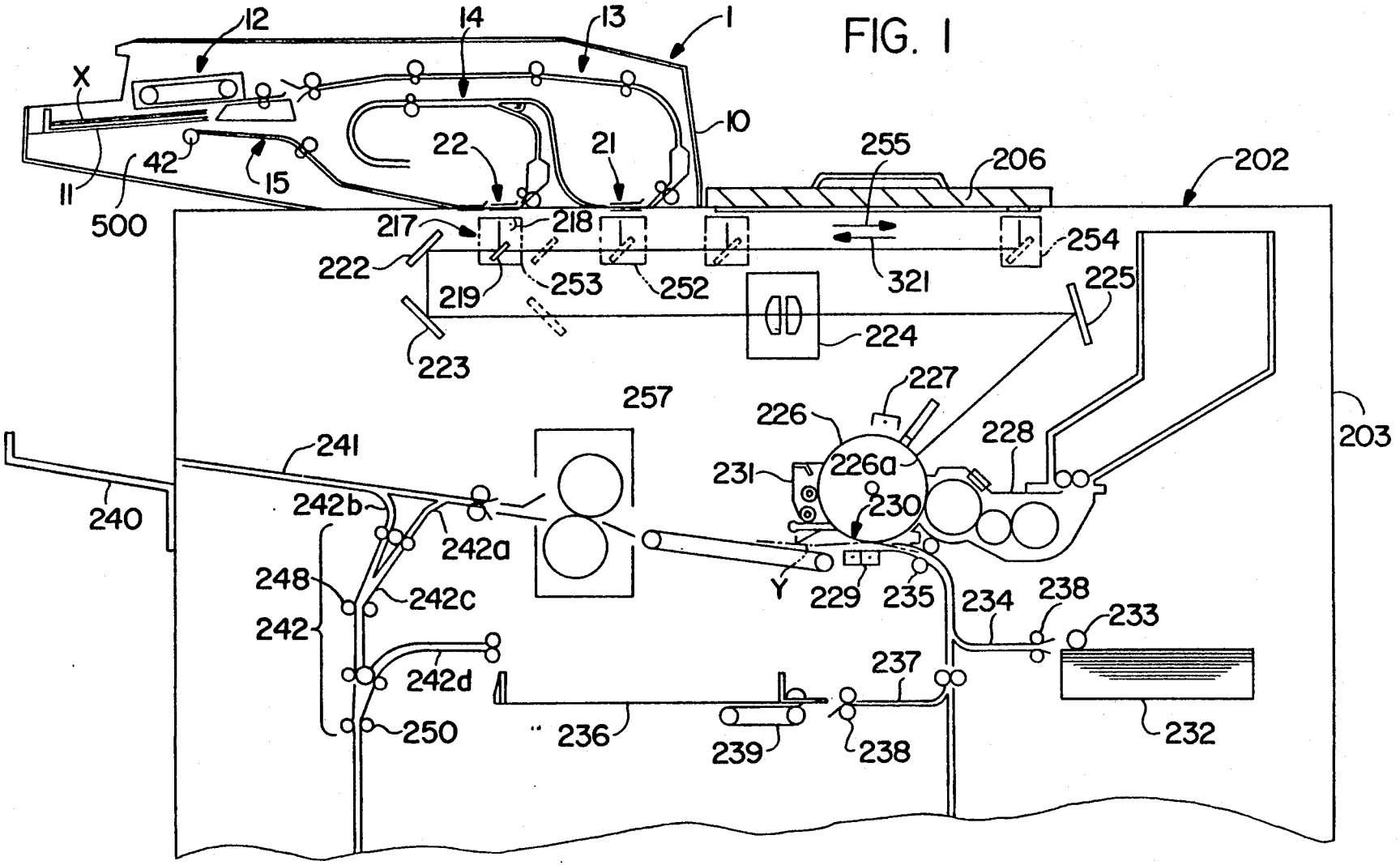
FIG. 1 is a side view showing a copying machine provided with a RDH that contains therein a paper accommodation of this invention.

FIG. 1 and FIGS. 6*a*–6*d* show a paper accommodation apparatus 500 of this invention, which is disposed within a recycling system automatic original feed apparatus (RDH) 1 loaded on a copying machine 202. The paper accommodation apparatus 500 comprises a paper (or original) stacker 11, one end of which has reference stoppers 31 and the other end of which has a lower return inlet 34. There is a paper discharge means 42 that is disposed in the vicinity of the lower return inlet 34, and a paper discharge guide 41 that is disposed at a position spaced from the reference stoppers 31 at a distance smaller than the size of papers accommodated in the paper stacker 11. A delivery means is included by which paper discharged from the lower return inlet 34 into the paper stacker 11 by means of the paper discharge means 42 is deflected so as to be fed into the paper stacker 11 beyond the paper discharge guide 41. A kick-up means 45 by which the rear end of the paper, the fore end of which has been restricted by the reference stoppers 31, is kicked up to be moved backwardly and held on the paper discharge guide 41.

The RDH 1 comprises the paper accommodation apparatus 500 having the stacker 11, a paper feed unit 12 for separating one by one the originals contained in the paper stacker 11 and for feeding them to an original recycling system. A first transport means 13 for transporting to a first exposure unit 21 the original separately fed, and a second transport means 14 for transporting in a reverse manner to a second exposure unit 22. The original is transported from the first exposure unit 21. A lower return means 15 is provided for transporting the original transported from the second exposure unit 22 to the lowermost portion of paper stacker 11. The RDH 1 is disposed within the casing 10.

Figure 10A:
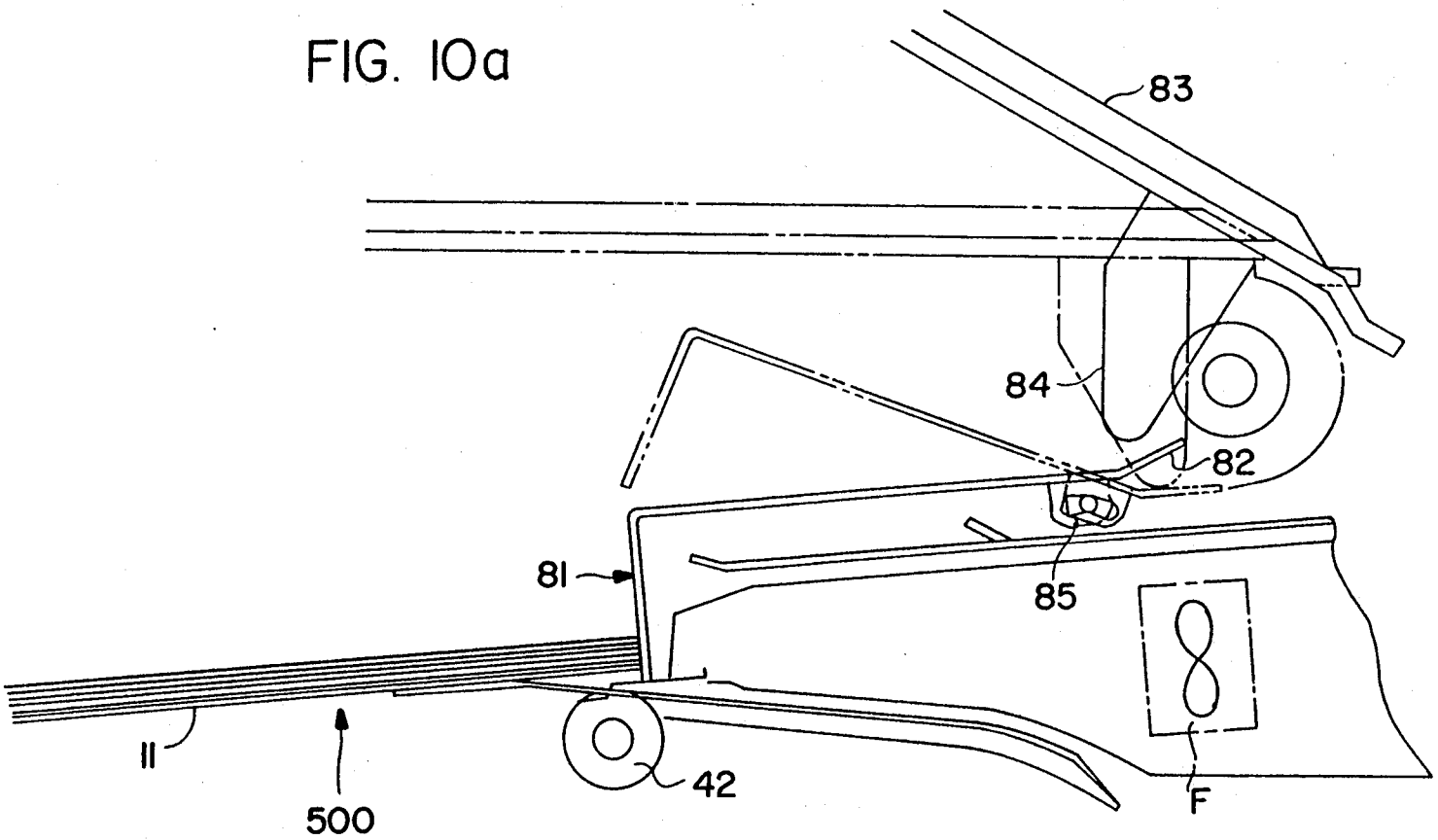
FIG. 10*a* is a schematic diagram showing a paper setting stopper that is disposed in the vicinity of a lower return inlet of a paper accommodation apparatus of this invention.
Figures 10B, 10C:
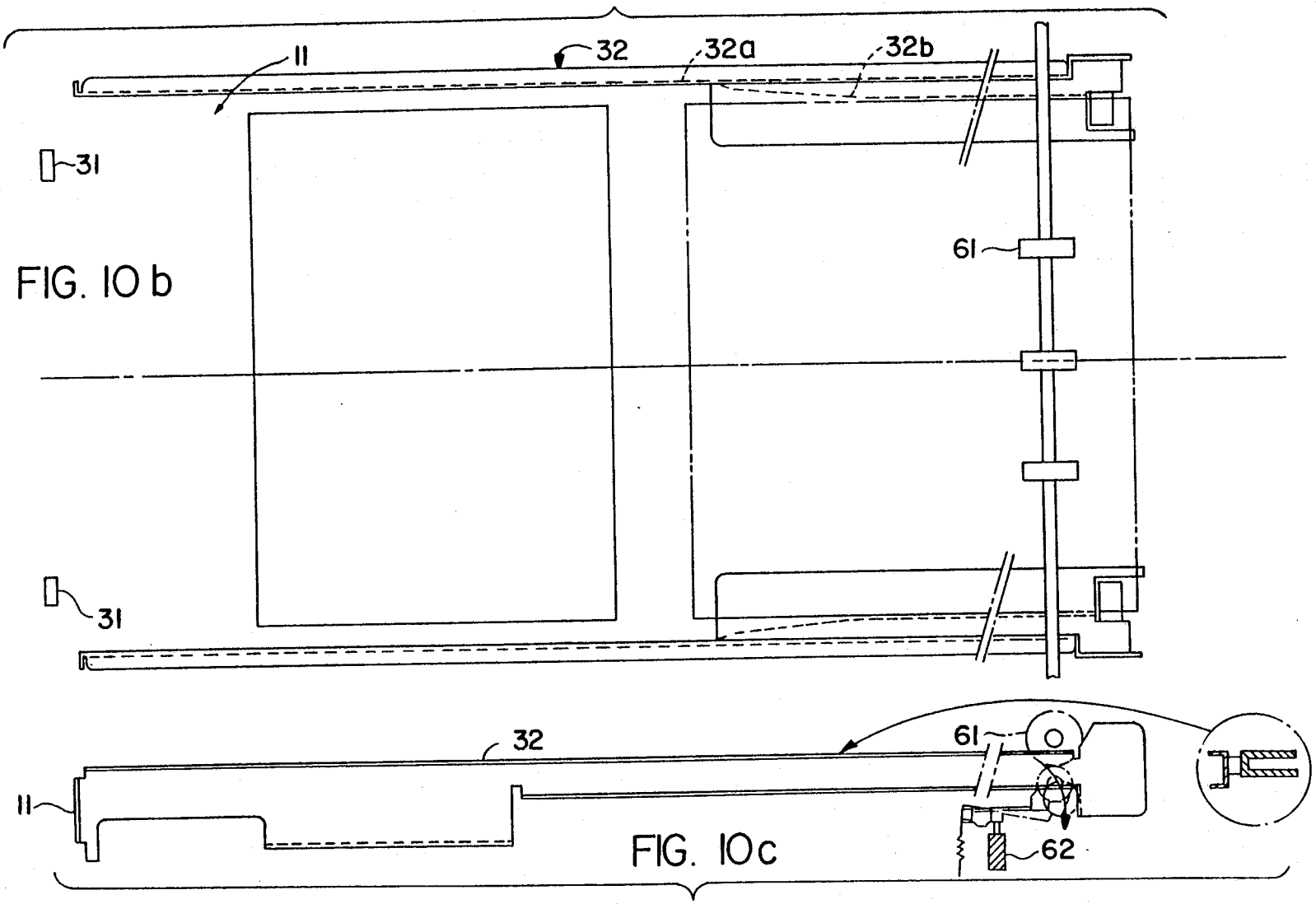
FIGS. 10*b* and 10*c*, respectively, are plan and side views showing width regulating plates used in a paper accommodation apparatus of this invention.

The paper stacker 11 constituting the paper accommodation apparatus 500 of this invention, as shown in FIGS. 10*b* and 10*c*, is large enough to accommodate originals of plural sizes and provided with reference stoppers 31 erected for regulating the fore ends of originals and a pair of width regulating plates 32 erected opposite to each other widthwise of the stacker 11, so that the positions of the reference stoppers 31 and width regulating plates 32 are adjustable. An original stacking portion 32*a* of the width regulating plates 32 has a width as large as the width of the original plus about 6 mm so as to facilitate accommodation of the originals returned after circulation. There is a transport starting portion 32*b* for holding the original to start the transport thereof that has a width, the width of the original plus about 2 mm smaller than the width of the stacking portion 32*a*, the stacking portion 32*a* and the transport starting portion 32*b* being U-like-shaped. Transport rollers in front and at the rear of the nip roller 61 are spaced at an interval larger than the length of the original, so that the original can be held by only nipper means such as nip rollers 61 when the originals are accommodated in the narrow transport starting portion 32*b*. Accordingly, when a nip roller solenoid 62 is turned on to release the original from being nipped by the nip rollers 61, the originals that have been contained in a misalignment manner within the transport starting portion 32*b* are simply widthwise aligned, thereby reliably preventing the originals from skewing and giving rise to a central misalignment.

Figure 3:
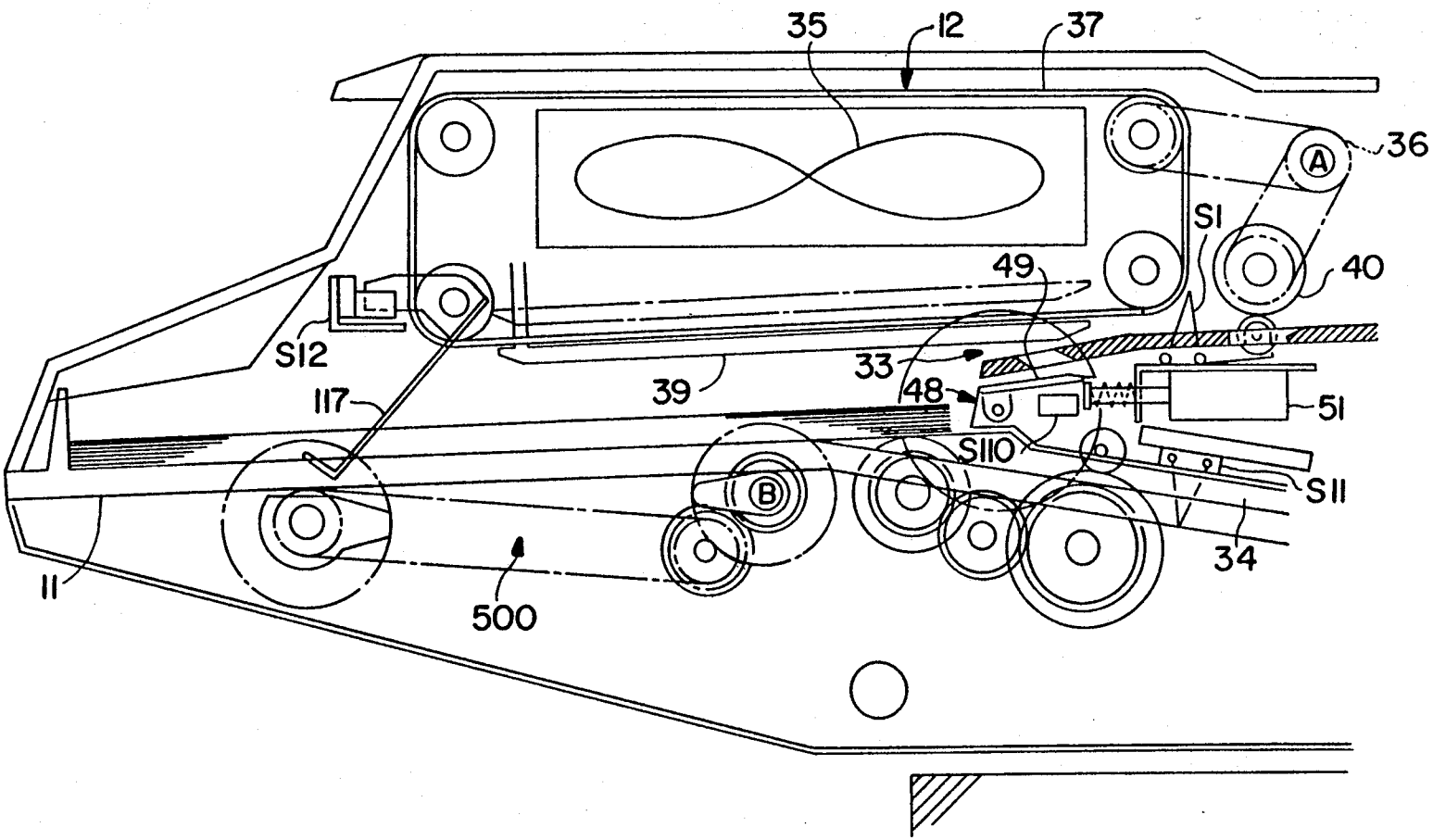
FIG. 3 is a side view showing an enlarged portion of the RDH of FIG. 2.
Figure 4:
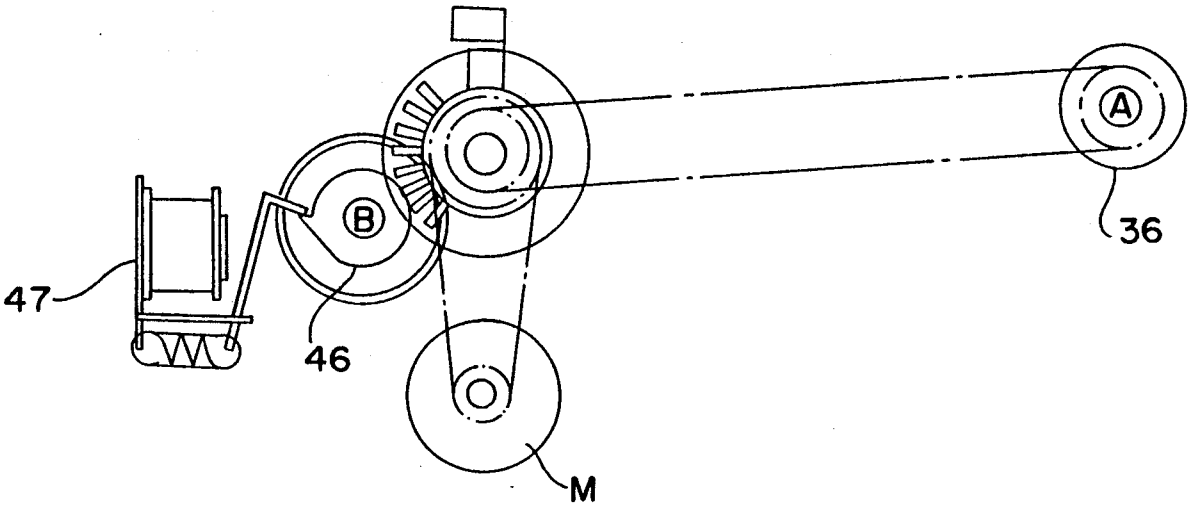
FIG. 4 is a schematic diagram showing a one-turn solenoid used in the RDH of FIG. 3.

At the end of the paper stacker 11 opposite to the above-mentioned reference stoppers 31 for regulating the fore ends of originals, as shown in FIG. 3, a paper feed exit 33 and the above-mentioned lower return inlet 34 spaced at a predetermined interval therebetween are positioned in a vertical direction. At the upper portion of the paper stacker 11 facing the paper feed exit 33 is disposed a paper feed unit 12 that is provided with a suction means and a transport system. The suction means is a suction fan 35 as shown in FIG. 3. The above-mentioned transport system comprises a transport belt 37 that is rotatably provided around the suction fan 35 by means of pulleys and connected to a shaft 36, the rotation of which is transmitted from a paper feed motor M (FIG. 4). The transport system further comprises paper feed rollers 40 connected to the shaft 36, a transport belt driving clutch 38 (FIG. 5) interposed between the motor M and the shaft 36 so as to drive or stop both the transport belt 37 and the paper feed rollers 40, and a separation block 39 disposed to be projectable and retractable from the surface of the transport belt 37. The original sucked by the suction fan 35 is attracted to the transport belt 37 so as to be transportable and the separation block 39 projects from the outer surface of transport belt 37 so as to stop the transportation of the original. The transport belt 37 is composed of a plurality of belts juxtaposed at predetermined intervals. The separation block 39 is composed of a comb with plural teeth that are disposed between the plural belts, respectively.

Figure 9A:
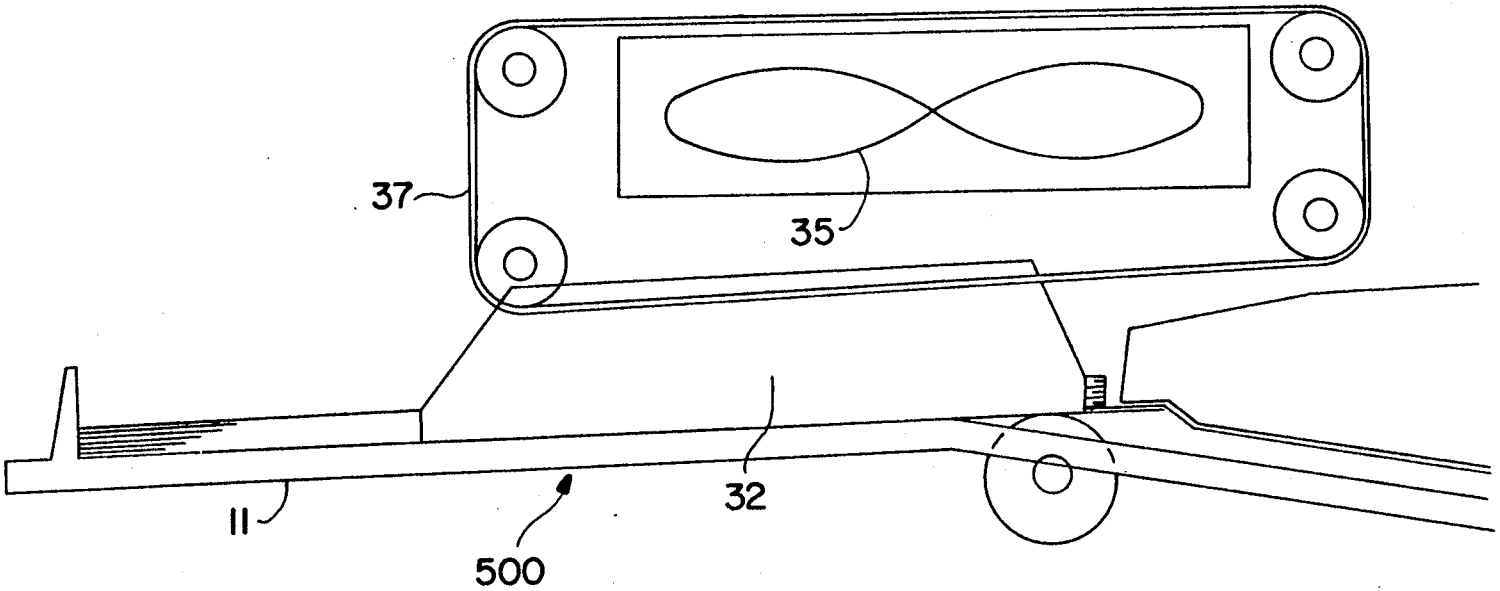
FIGS. 9*a* and 9*b*, respectively, are side and front views showing a suction fan that is disposed above the paper accommodation apparatus of this invention.
Figure 9B:
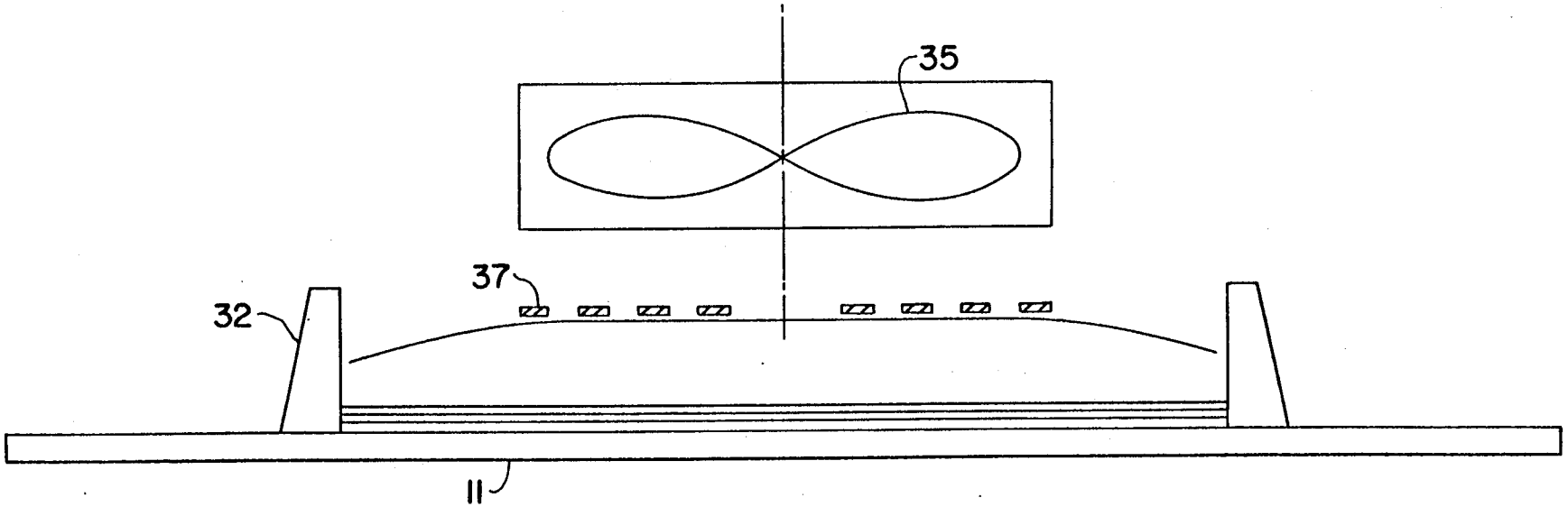

The suction fan 35, as shown in FIGS. 9*a* and 9*b*, is disposed in a central portion of the width regulating plates 32 and on the way that the originals accommodated in the paper stacker 11 are transported. The width of the transport belt 37 for holding the original attracted by the suction fan 35 is substantially equal to that of the suction fan 35. Accordingly, the original, the front of which has been attracted in the paper feed direction to the transport belt 37, inclines forwardly upwardly and is deflected downwardly at both sides, whereby even when a plurality of originals are attracted without being separated from each other, the deflection causes a gap between the upper and the lower originals, which makes it easy to separate one from another. Also, the transport surface of transport belt 37 is positioned lower than the upper end of each width regulating plate 32, which enables the original to be effectively attracted.

Figure 2:
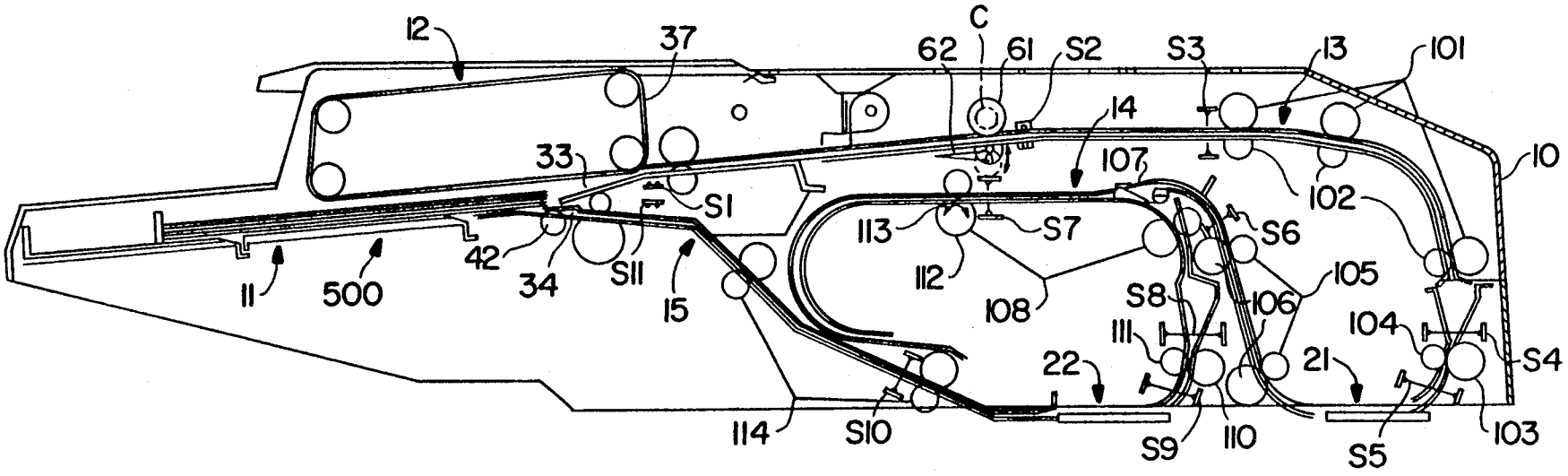
FIG. 2 is a side view showing the RDH of FIG. 1.

As shown in FIGS. 2 and 3, the suction fan 35 is always driven to drive and stop the transport belt 37 or to project and retract the separation block 39, thus controlling transportation of the originals. In other words, when the suction fan 35 and transport belt 37 are driven in a state that the separation block 39 is projected, the original is attracted toward the transport belt 37, but does not contact the transport belt 37, so that the original is not transported. When the separation block 39 is retracted in such a state, the original immediately contacts the transport belt so as to be transported, thus obtaining a transportation system suitable for high speed operation. The belt drive clutch 38 for the transport belt 37 is skewed when the separation block 39 is retracted for attracting the original during the rotation of transport belt 37. To prevent the clutch 38 from being skewed, the transport belt 37 once stops to retract the separation block 39 and thereafter the belt drive clutch 38 is controlled to drive the transport belt 37, thus transporting the original. The reference numeral 61 designates nip rollers, and C designates a nip roller clutch (FIG. 2).

Figure 6A:
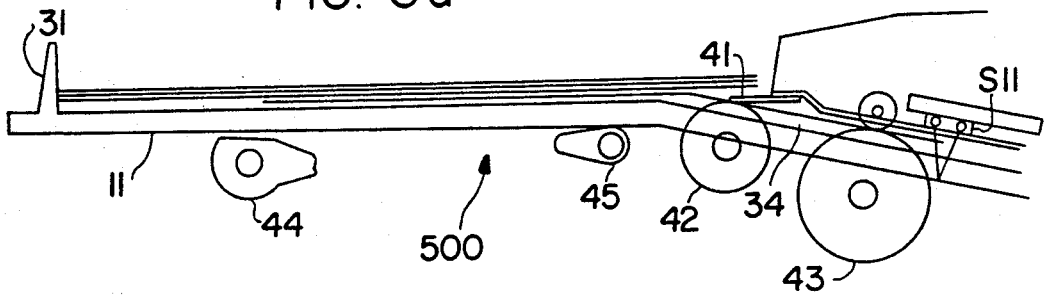
FIGS. 6*a*, 6*b*, 6*c* and 6*d* are schematic diagrams showing operation of a paper accommodation apparatus of this invention.
Figure 6B:
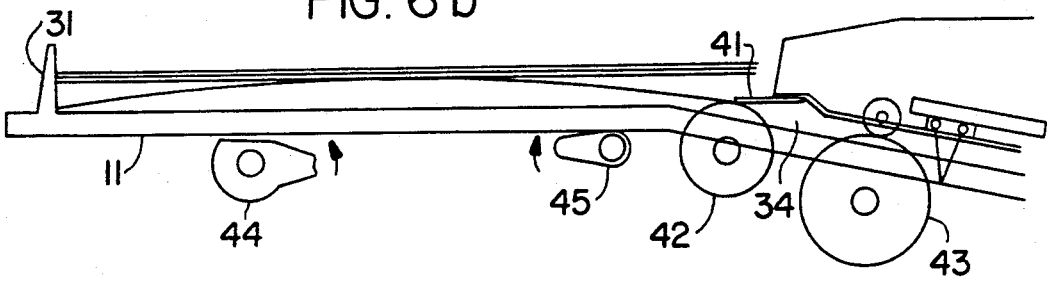
Figure 6C:
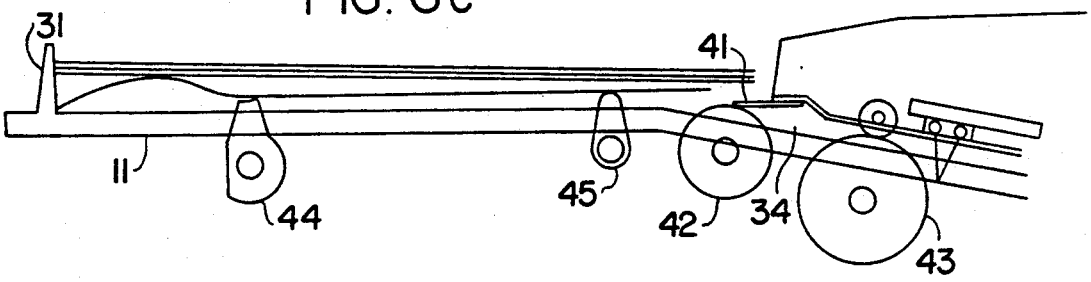

As shown in FIGS. 6*a* to 6*d*, the lower return inlet 34 is inclined at the surface of paper stacker 11 so as to discharge the original toward the reference stoppers 31, and a discharge guide 41 is provided at a position spaced from the reference stoppers 31 at a distance smaller than the size (length) of the original. The discharge guide 41 is made of an elastic material, such as Mylar or the like, so as to hold on the lower return inlet 34 the rear end of the original discharged from the lower return inlet 34. At the lower return inlet 34 is provided a paper discharge means composed of a paper discharge roller 42 that is in contact with the discharge guide 41, the roller 42 together with a paper discharge auxiliary roller 43 delivering the original into the paper stacker 11 through the lower return inlet 34 (FIGS. 6*a* and 6*b*).

The original, even after the fore end of the original has come into contact with the reference stoppers 31, is deflected by a delivery means attached to the paper stacker 11 and sent inside of the paper stacker 11 until the rear end of the original moves beyond the paper discharge guide 41. The delivery means comprises a semicircular roller 44 that is freely projectable and retractable from the bottom surface of the paper stacker 11 at the reference stopper 31 side. The semicircular roller 44 rotates in the paper discharge direction and still delivers and deflects the original even after the fore end of the original has been regulated by the reference stoppers 31. The original, which has been delivered to be regulated at the fore end by the reference stoppers 31 and has completely passed beyond the paper discharge guide 41, is kicked up at the rear end (FIG. 6*c*) by a kick-up means that is composed of a kick-up lever 45 rotatable reversely to the semicircular roller 44, thereby moving rearwardly and being finally held on the paper discharge guide 41 (FIG. 6*d*). The semicircular roller 44 and kick-up lever 45 are connected by a gear and a transmission belt so as to normally and reversely rotate, and intermittently driven by a one-turn solenoid 47 engageable with a cam 46 that is associated with a paper feed motor M as shown in FIGS. 3 to 5.

In the aforesaid embodiment, the semicircular roller 44 can be omitted therefrom and its delivery operation is performed by the paper discharge roller 42 and paper discharge guide 41. The delivery operation is shown in FIGS. 6*e* to 6*h*, which is the same as that in FIGS. 6*a* to 6*d* except that the paper discharge roller 42 operates instead of the semicircular roller 44.

The paper discharge guide 41 made of an elastic piece contacts the paper discharge roller 42 at the paper discharge guide 41 side before a point at which the paper discharge guide 41 is tangent to the paper discharge roller 42 so that the kick-up lever 45 ensures the kicking-up of original onto the paper discharge guide 41.

Figure 5:
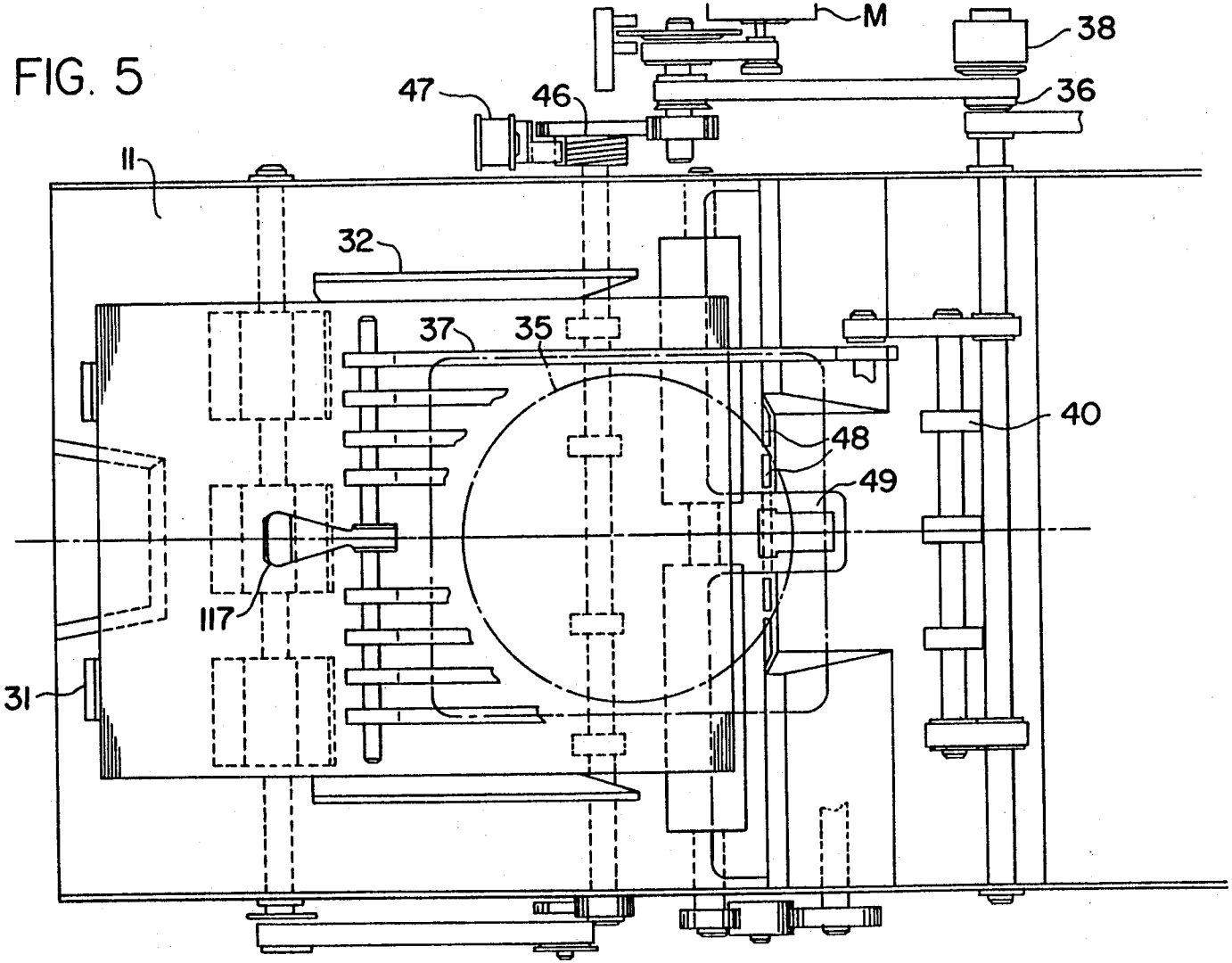
FIG. 5 is a plan view showing a portion of the RDH of FIG. 2.
Figure 6D:
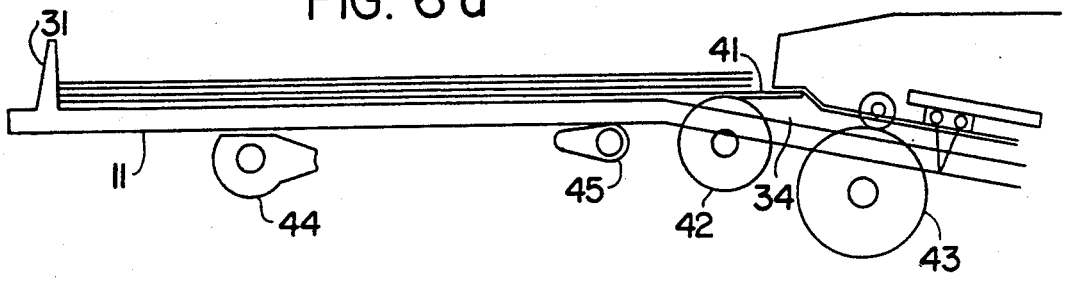
Figure 6E:
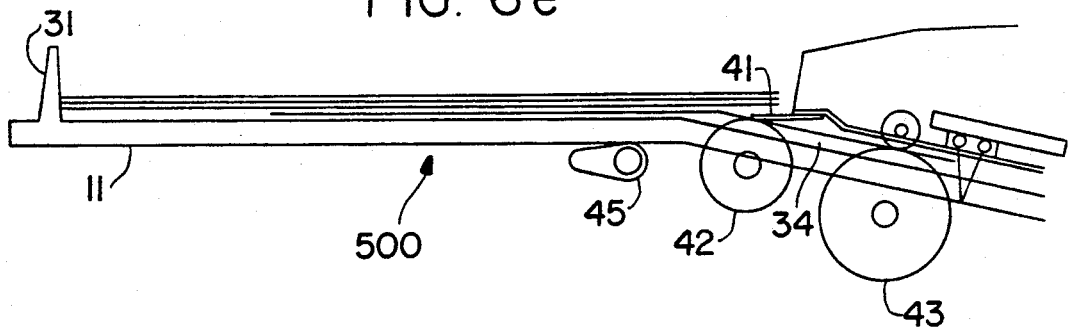
FIGS. 6*e*, 6*f*, 6*g* and 6*h* are schematic diagrams showing the operation of other paper accommodation apparatus of this invention.
Figure 6F:
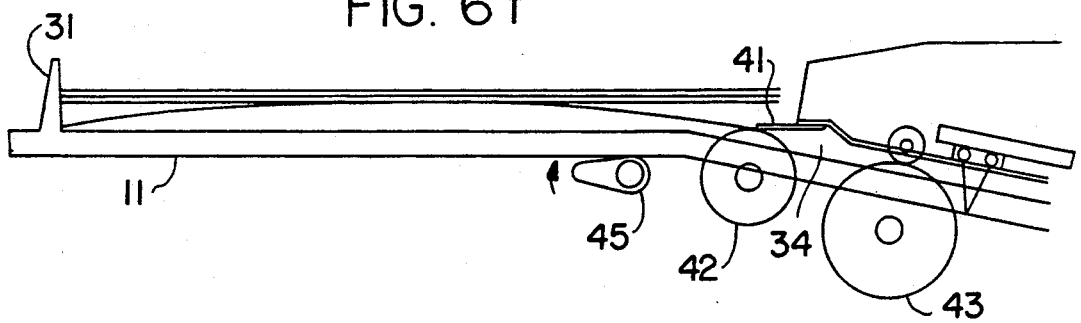
Figure 6G:
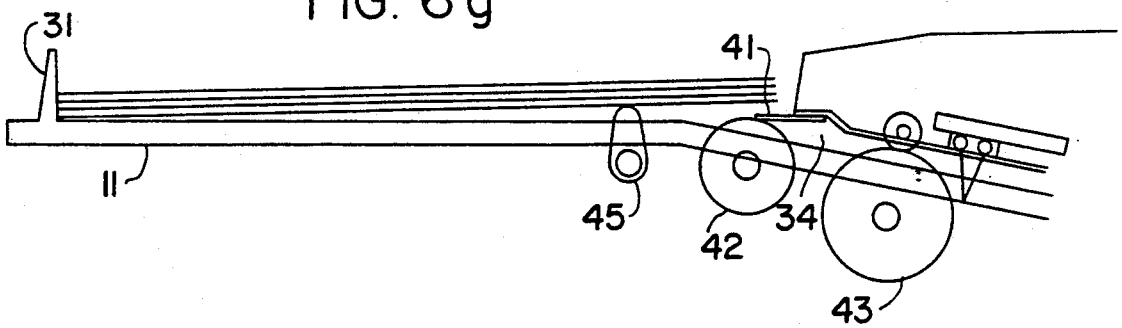
Figure 6H:
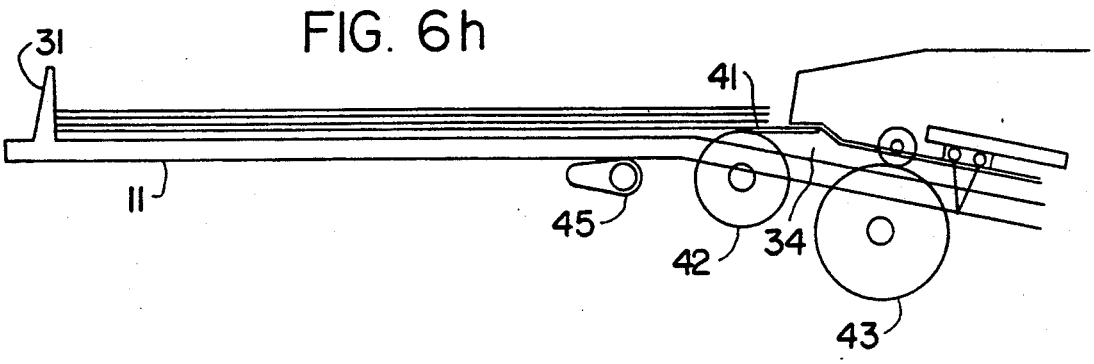

As shown in FIGS. 3 and 5, between the paper feed exit 33 and the lower return inlet 34 that are vertically spaced from each other at a predetermined interval is formed an air port 48 for blowing off air toward the original attracted to the transport belt 37. The air blown off from the air port 48 makes it easy to separate the original from others and to float the original so that the original can be easily returned below the lowermost one of the remaining originals of the paper stacker 11.

At the air port 48 is pivoted a recycle lever 49 so that its rotary path is involved in the paper feed exit 33 and lower return inlet 34. At an intermediate portion between the paper feed exit 33 and the lower return inlet 34 in the air port 48 are provided a standby means and a counting means, i.e., a recycle solenoid 51 and a recycle sensor S110. The recycle sensor S110 detects that the recycle lever 49 passes thereby and is in engagement with the recycle solenoid 51.

Figure 8A:
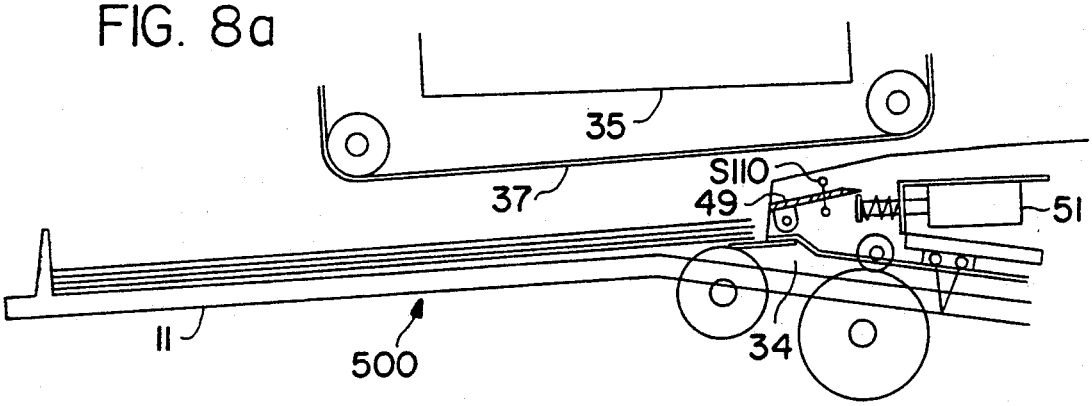
FIGS. 8*a*, 8*b*, 8*c*, 8*d*, 8*e*, 8*f*, and 8*g* are schematic diagrams showing the operation of the recycle lever used in a paper accommodation apparatus of this invention.
Figure 8B:
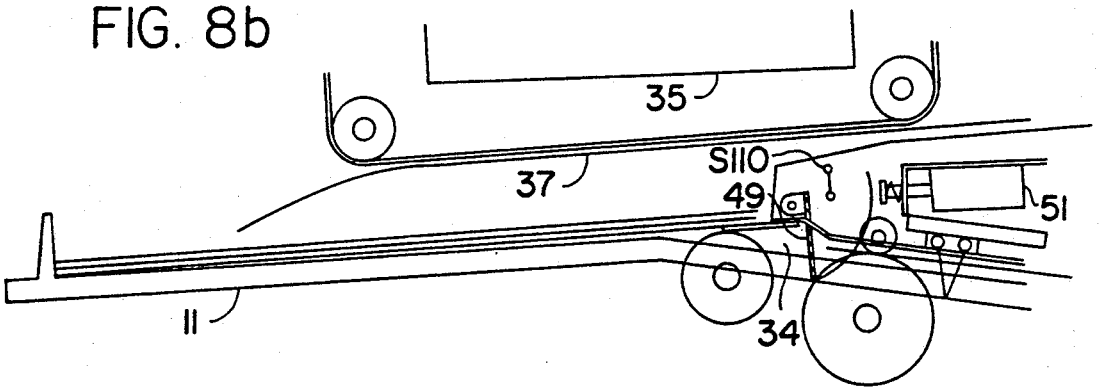
Figure 8C:
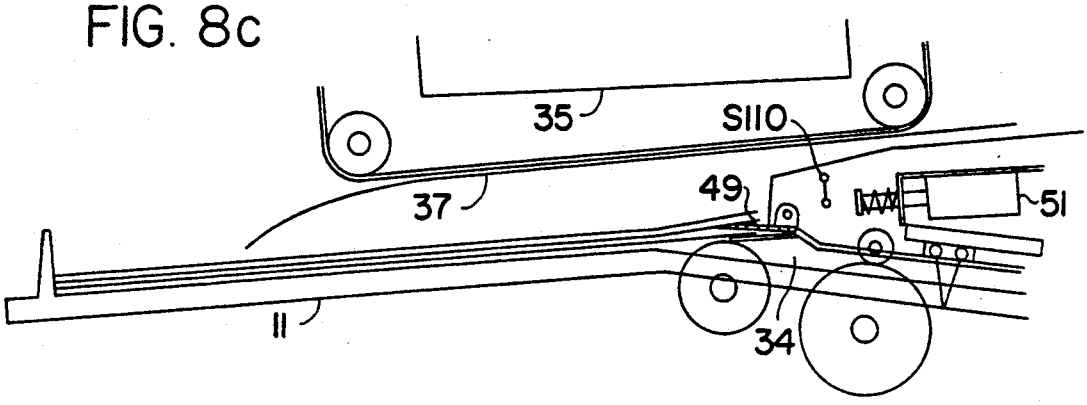
Figure 8D:
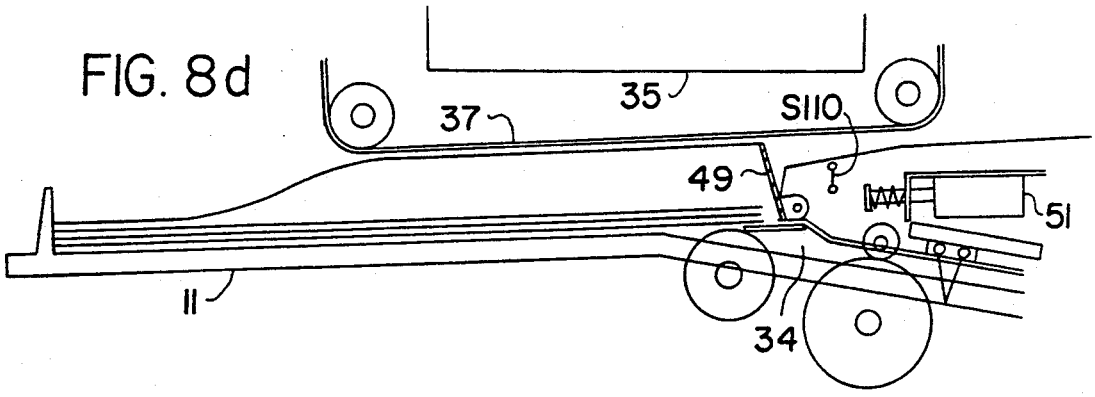
Figure 8E:
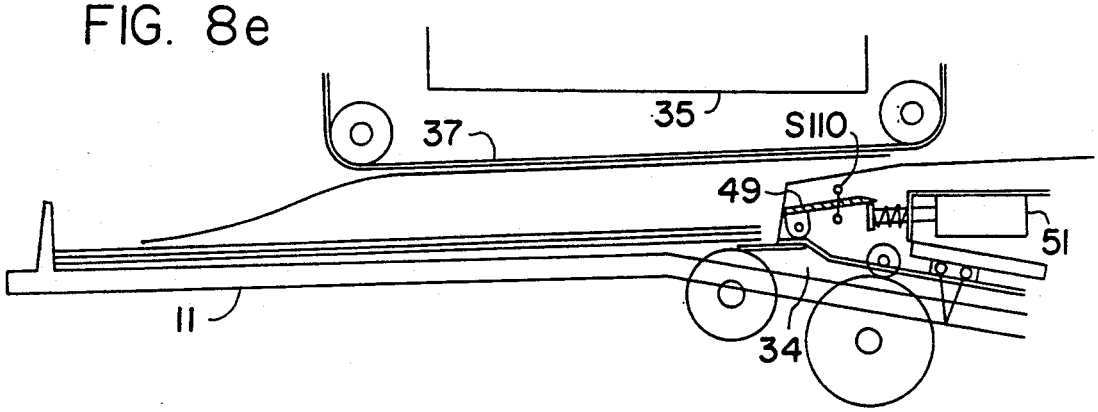
Figure 8F:
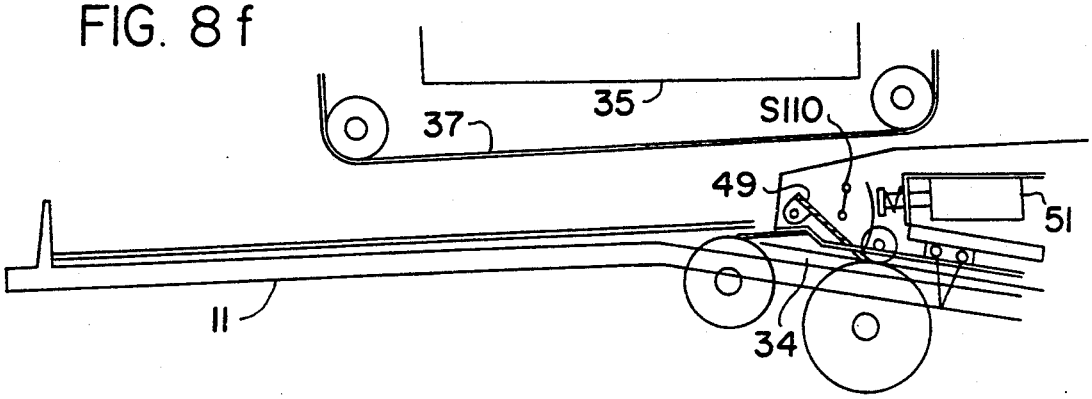
Figure 8G:
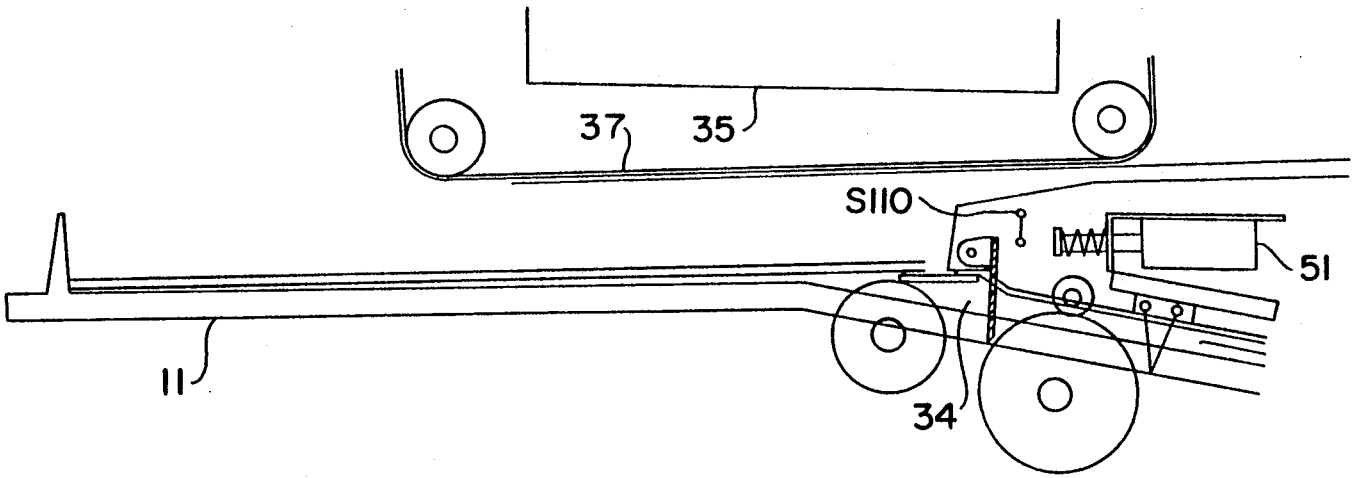

The above-mentioned recycle lever 49, as shown in FIGS. 8*a* through 8*g*, is not connected to a drive mechanism, but normally downwardly hangs to intersect with the lower return inlet 34. The recycle lever 49 operates as follows: First of all, the recycle lever 49 that is in engagement with the recycle solenoid 51 (FIG. 8*a*) is downwardly hung by turning on the recycle solenoid 51 (FIG. 8*b*). Next, when a first original passing through the lower return inlet 34 is accommodated in the paper stacker 11, the recycle lever 49 also rotates together with the movement of the original so as to move onto the rear end of the first original of the paper stacker 11 (FIG. 8*c*). Next, when the original is attracted to the transport belt 37 by the suction fan 35 and moves in the paper feed direction from the paper feed exit 33, the recycle lever 49 also rotates to engage with the recycle solenoid 51 (FIGS. 8*d* and 8*e*) and waits for a predetermined time, at which time the recycle sensor S110 is turned on so as to judge that the original just before one which begins to be fed is the last one, thereby automatically counting one feed cycle of the originals. During this waiting period, the last original is delivered from the lower return inlet 34 into the paper stacker 11, and accordingly, after the fore end of the original passes through the lower return inlet 34, the recycle solenoid 51 is turned on to release the recycle lever 49 from being held onto the recycle solenoid 51 and the recycle lever 49 falls due to its own weight to intersect with the lower return inlet 34 (FIG. 8*g*). Thereafter, such an operation is repeated.

Figure 14A:
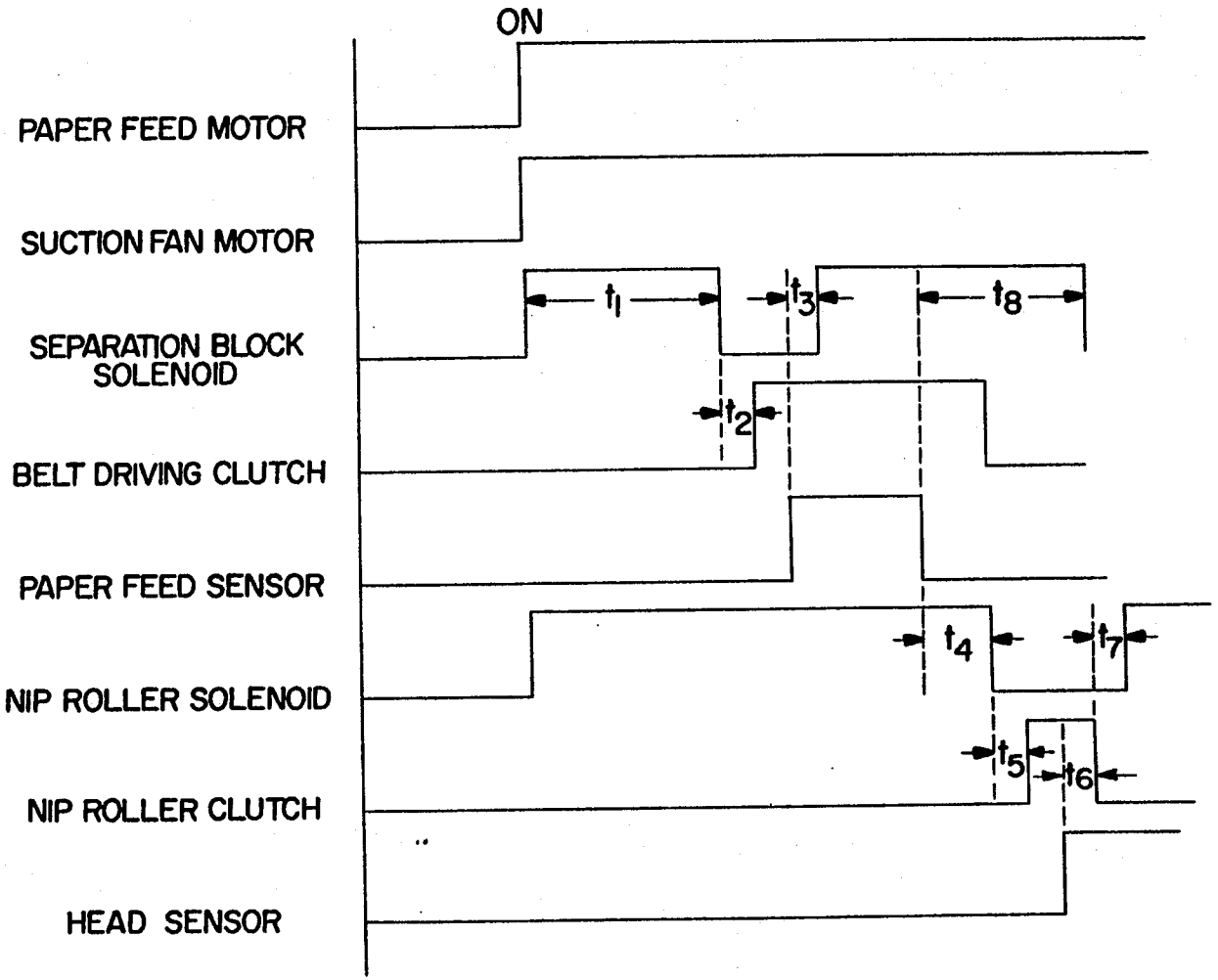
FIGS. 14*a*, 14*b* and 14*c*, respectively, are timing charts showing the transport of paper in the RDH of FIG. 1.
Figure 14B:
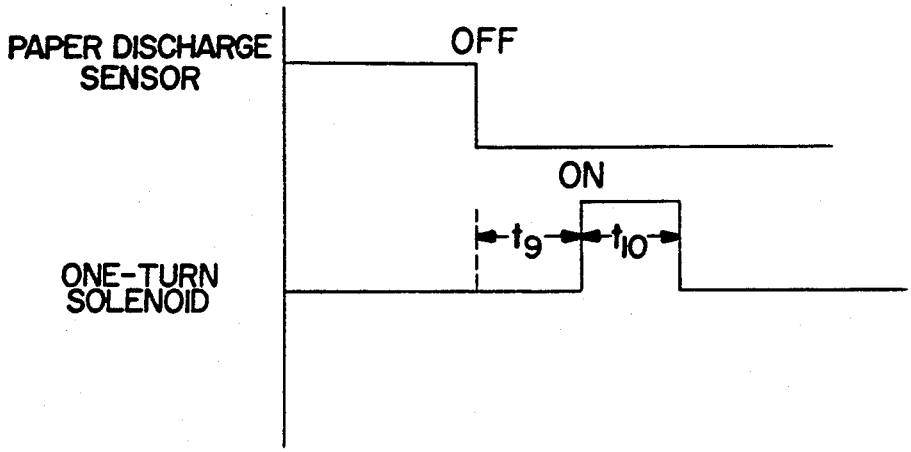
Figure 14C:
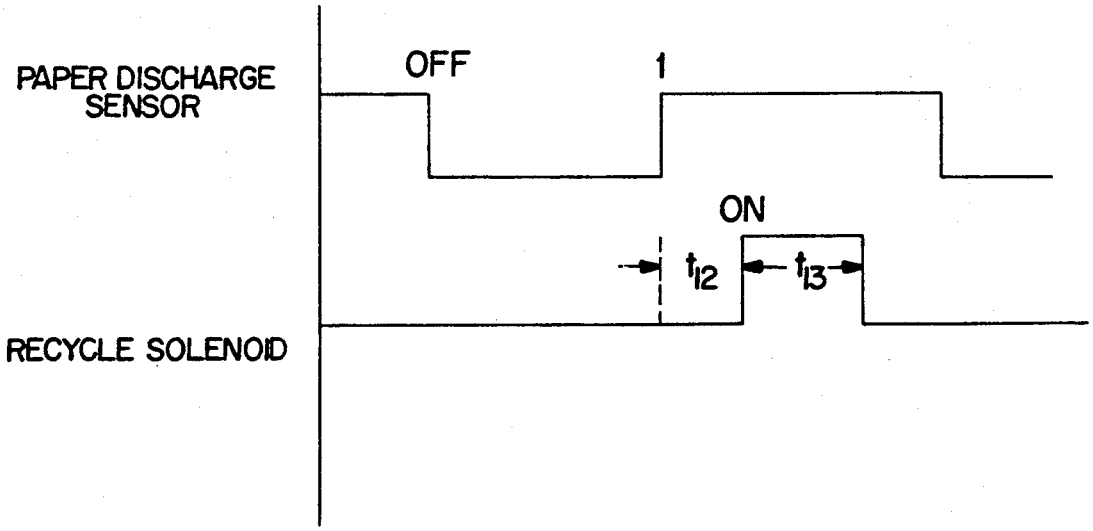

The timing of turning-on of the recycle solenoid 51 to fall the recycle lever 49 so as to intersect with the lower return inlet 34 after the holding of the recycle lever 49 onto the solenoid 51 begins, as shown in FIG. 14*c*, is after the lapse of time of $t_{12}$ from a time when the paper discharge sensor S11 that is positioned at the upstream side of the intersection between the recycle lever 49 and the lower return inlet 34 detects the last original passing therethrough, to a time when the original reaches the above-mentioned intersection. Even when the recycle solenoid 51 is turned on to release the recycle lever 49 from being held onto the recycle solenoid 51 so as to fall the recycle lever 49 onto the last original (FIG. 8*f*), the recycle lever 49 is held thereon until the last original completes to pass through the recycle lever 49. Accordingly, the recycle lever 49 does not create any problem in counting. Reference numeral $t_{13}$ designates a time from the turning-on of the recycle solenoid 51 to the end of the falling of the recycle lever 49.

Figure 7:
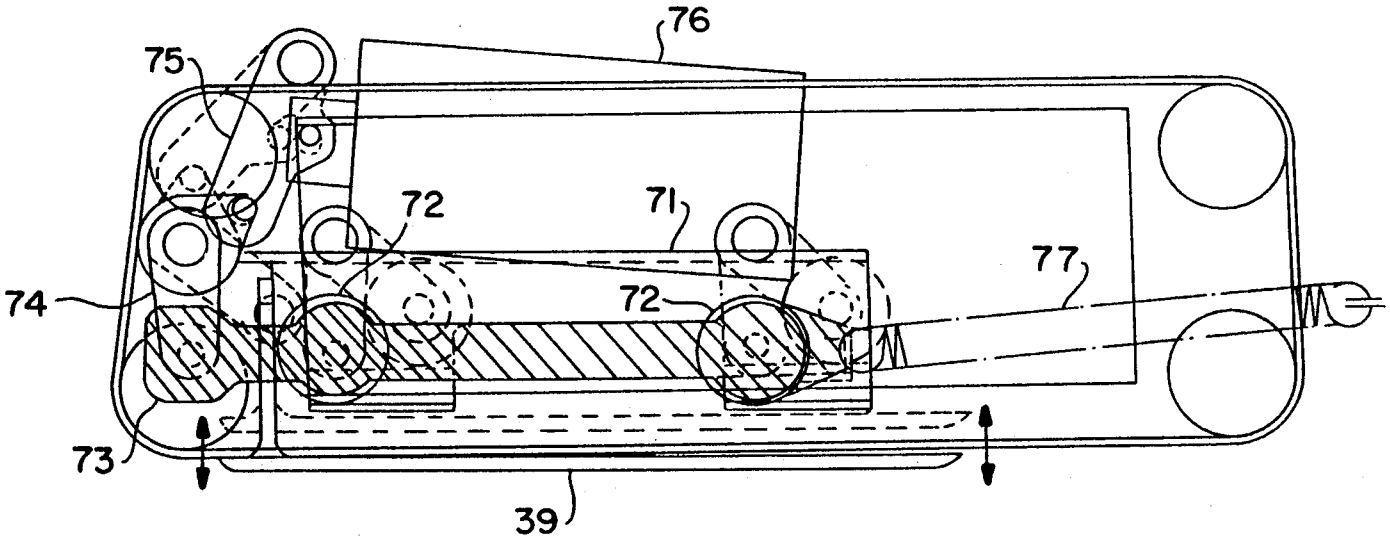
FIG. 7 is a schematic diagram showing a reparation block used in the RDH of FIG. 3.

The mechanism for projecting and retracting the separation block 39 from the surface of the transport belt 37 is explained by a structure shown in FIG. 7. In detail, a slide guide 71 is attached to the separation block 39 and lifted by a plurality of swinging rollers 72 in association with each other by a connecting bar 73 which is connected to a link driving lever 75 by means of a linkage mechanism 74. The link driving lever 75 is pulled at a predetermined angle by a separation block solenoid 76 so that the connecting bar 73 goes down, and at the same time, the swinging rollers 72 pushes down the slide guide 71 to lower the separation block 39 that is one with the slide guide 71. Accordingly, the separation block 39 projects from the surface of the transport belt 37. A spring 77 acts to pull the connecting bar 73 so as to restore the separation block 39 to the original position thereof.

At the end of the paper stacker 11 that is positioned in the paper feed direction is vertically movably provided an original setting stopper 81 as shown in FIG. 10*a*, which rises from the set position when the paper feed starts. The rear portion 82 of the original setting stopper 81 extends beyond the pivot position thereof. An original set cover 83 is pivoted onto the paper stacker 11 so that it can be freely opened and closed. A pin 84 that is provided at the original set cover 83 pushes down the rear portion 82 of the original setting stopper 81, so that the original setting stopper 81 can be lifted. Accordingly, when the original set cover 83 is opened so as to set the originals within the paper stacker 11, the stopper 81 is positioned at the original set position, and, when the original set cover 83 is closed after the originals have been set, the stopper 81 rises from the set position. When an elongate slot 85 extending lengthwise of the stopper 81 is provided at the pivot portion thereof, a path of the fore end of the original set stopper 81 does not intersect with the end of each original, whereby there is no fear that the originals loaded on the paper stacker 11 are disarranged.

Figures 11A, 11B, 11C:
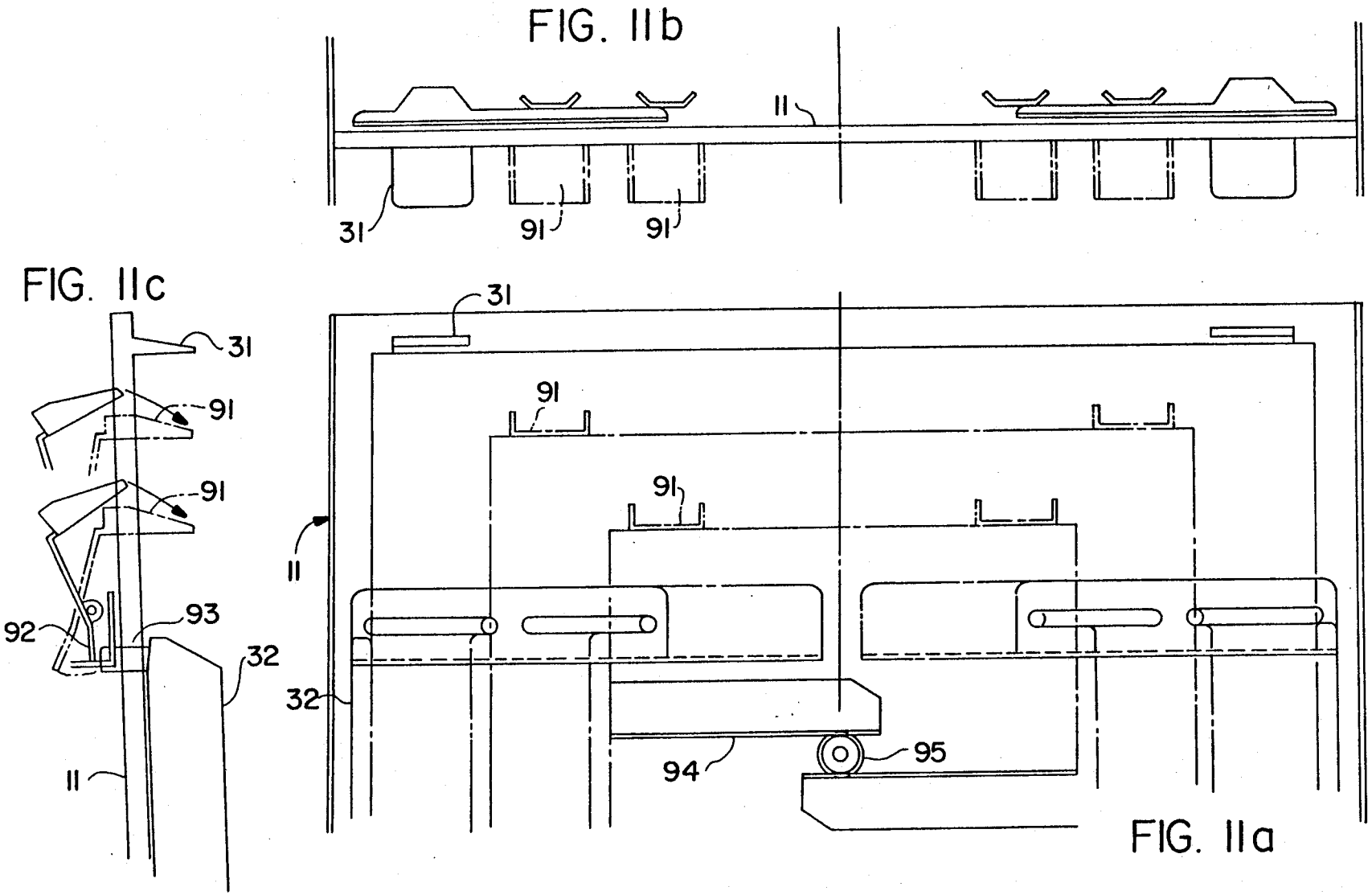
FIGS. 11*a*, 11*b* and 11*c*, respectively, are plan, front and side views showing an operation mechanism of the width regulating plates coupled to movable stoppers of a paper accommodation apparatus of this invention.

As shown in FIGS. 11*a* to 11*c*, each pair of movable stoppers 91 are provided inside of each reference stopper 31 at the paper stacker 11 corresponding to the size of original and are associated with the width regulating plates 32. The movable stoppers 91 are vertically swingably pivoted below the paper stacker 11. The rear end 92 of each stopper 91 extends so that the projection 93 downwardly extending from each width regulating plate 32 pushes down the rear portion 92, thereby projecting the stopper 91 upwardly from the bottom surface of paper stacker 11. The reference numerals 94 and 95 designate a rack and a pinion, respectively, which associate with the width regulating plates 32 at both sides of the stacker 11 so as to push up and down the pair of movable stoppers 91.

With the transport system by which the originals are separately supplied to each exposure unit shown in FIGS. 1 and 2, the first transport means 13 for feeding the original to the first exposure unit 21 comprises a plurality of first transport rollers 102 that are batch-controlled by a first transport roller clutch 101, and a first resist roller 104 that is driven and controlled by a first resist roller clutch 103. The reference numeral S3 designates a head sensor for detecting that the original reaches the first transport roller 102, S4 designates a first exposure resist sensor, and S5 designates a first exposure timing sensor.

The original transported from the first exposure unit 21 is turned over and fed so as to be set at the second exposure unit 22. The second transport means 14 is provided with a plurality of second transport rollers 106 that are batch-controlled by a second transport roller clutch 105, a second transport roller 109 and a switchback roller 112, both of which are batch-controlled by a third transport roller clutch 108, after switchback, at a switchback route branching from the transport route through an inversion gate 107, and a second resist roller 111 that is driven and controlled by a second resist roller clutch 110 at the upstream side of the second exposure unit 22. The reference numeral 113 designates a switchback solenoid, S6 designates a switchback timing sensor, S7 designates a switch back roller inlet sensor, S8 designates a second exposure resist sensor, and S9 is a second exposure timing sensor.

The original transported from the second exposure unit 22 is transported to the lower return inlet 34 by a plurality of transport rollers 114. The reference numeral S11 designates a paper discharge timing sensor.

Figure 12:
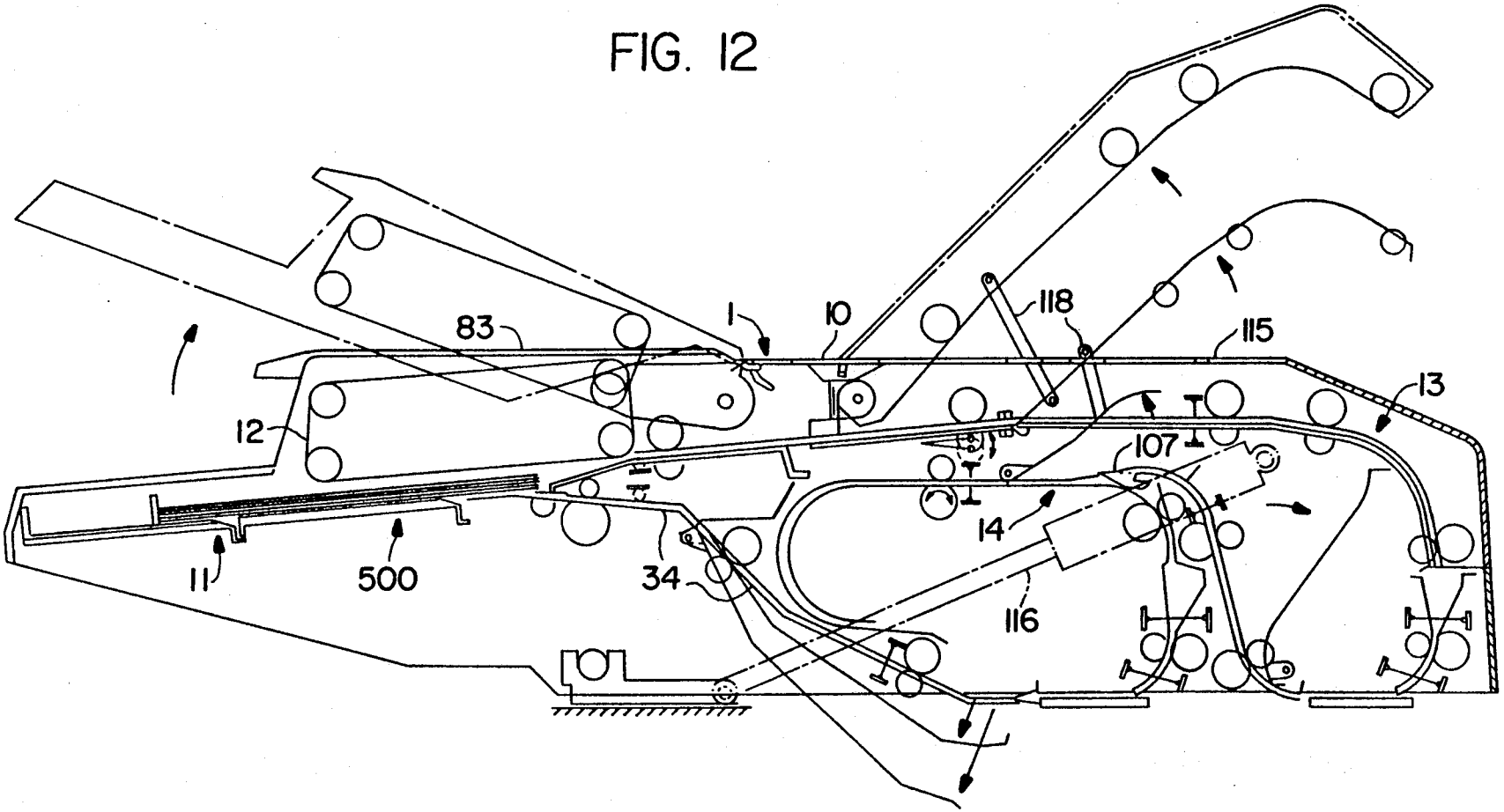
FIG. 12 is a schematic diagram showing opening and closing mechanisms of a cover of each of the paper accommodation apparatus and the transport system of the RDH shown in FIG. 1.

The paper feed unit 12, as shown in FIG. 12, is accommodated in the original set cover 83 that is mounted to the paper stacker 11 at the casing 10 of RDH 1 in relation of so that the cover 83 can be freely opened and closed. Accordingly, the upper portion of the paper stacker 11 can be opened by opening the original sect cover 83.

In the transport system for feeding the original to the exposure unit, jams can be attended to by opening a body cover 115. The upper portion of the first transport means 13 that is integrally mounted to the body cover 115, the lower portion of the first transport means 13, the upper portion of the second transport means 14, and the upper portion of the inversion gate 107 are individually opened. Moreover, the transport portion positioned toward the lower return inlet 37 can be downwardly opened in such a state that the RDH 1 that is entirely rotatable in a seesaw manner is opened at the above-mentioned transport system side by driving a gas damper 116.

The upper portion of the first transport means 13, the lower portion thereof, and the upper portion of the inversion gate 107 are connected to each other by means of a linkage mechanism 118. They are gradually separately opened up to a predetermined angle by which they are inclined to the original set positions and, when opened at an angle larger than the predetermined angle, they are fully opened all at once.

Figure 13:
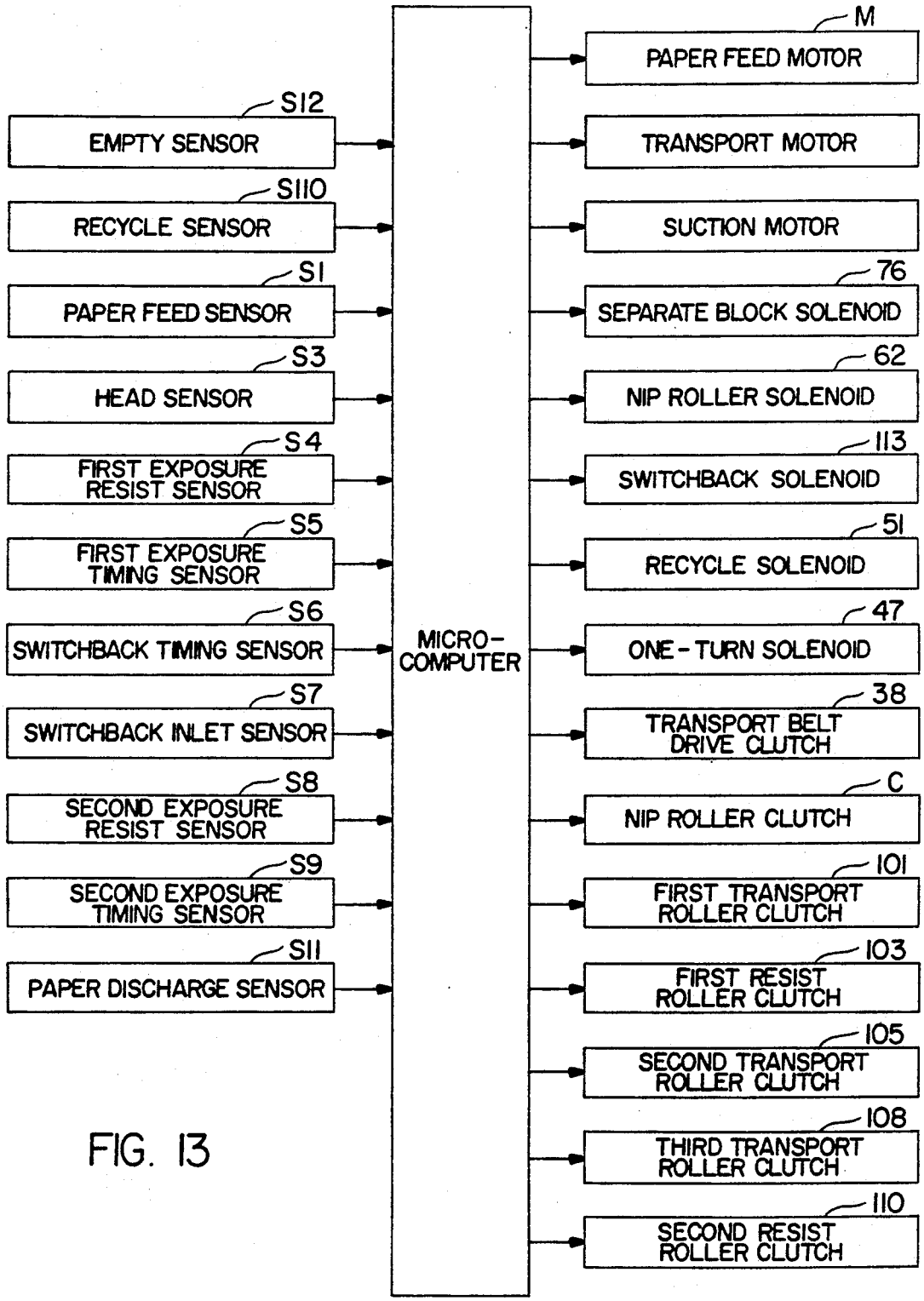
FIG. 13 is a block diagram showing the RDH of FIG. 1.

The RDH 1 operates as follows: FIG. 13 is a block diagram of the operation of RDH 1.

First of all, the original set cover 83 is opened, the width regulating plates 32 are adjusted to the original size, the originals are set in alignment to the original setting stopper 81, and the cover 83 is closed. When a copy button at the copying machine side is turned on, the suction fan 35, air blow fan F (FIG. 10*a*), paper feed motor M, and transport motor (not shown) operate to turn on the separate block solenoid 76, thereby projecting the separate block 39 from the surface of the transport belt 37, and the nip roller solenoid 62 is energized to release the holding of the original by the nip rollers 61. At the same time, the first transport roller clutch 101, resist roller clutch 103, second transport roller clutch 105, and third transport roller clutch are turned on.

As shown in FIG. 14*a*, after the lapse of time $t_1$, the separate block solenoid 76 is turned off and after the lapse of time $t_2$, the transport belt drive clutch 38 is turned on to start a paper feed process. After the lapse of time $t_3$ since the paper feed sensor S1 is turned on, in other words, in a state that the fore end of the original can be transported by the paper feed roller 40, the separate block solenoid 76 is turned on so as to separate the transport belt 37 from the original, thereby feeding the originals one by one.

Next, after the lapse of time $t_4$ since the original has passed the paper feed sensor S1, the nip roller solenoid 62 is turned off and the nip rollers 61 hold the original. After the lapse of time $t_5$, the nip roller clutch 63 is turned on to restart the transportation of the original. After the lapse of time $t_8$ since the original has passed by the paper feed sensor S1, when an empty lever 117 is positioned on the original and the empty sensor S12 is turned on, a series of paper feed operations start after the separation block solenoid 76 has been turned off.

After the lapse of time $t_6$ since the head sensor S3 is turned on, that is, when the original reaches the second transport roller 106 driven by the transport motor, the nip roller clutch 63 is turned off to stop the drive of the nip rollers 61 and after the lapse of time $t_7$ and after the nip roller solenoid 62 is turned on to release the holding of the original by the nip rollers 61, the second transport roller 106 alone transports the original.

After the original passes by the first exposure resist sensor S4 and first timing sensor S5 and reaches the switchback timing sensor S6 and switchback roller inlet sensor S7, and after the lapse of a predetermined time until the original has passed by the switchback timing sensor S6 so as to pass through the fore end of the inversion gate 107, the switchback solenoid 113 is turned on to reversely rotate the switchback roller 112, thereby attaining a switchback-transportation of the original below the inversion gate 107.

The transportation of the second and later sheets of originals is as follows: After the lapse of a predetermined time for which the original reaches an area positioned just before the switchback inlet sensor S7 since the original has reached the switchback timing sensor S6, when the rear end of a sheet just before the original turns on the switchback inlet sensor S7, the second transport roller clutch 105 and all the originals at the upstream side of the clutch 105 entirely stop. In other words, the first resist roller clutch 103, first transport roller clutch 101, nip roller clutch 63, and belt drive clutch 38 are turned off respectively. The original that had stopped when the sheet just before the original has passed by the switchback inlet sensor S7, turns on the clutches among the first resist roller clutch 103, first transport roller clutch 101, nip roller clutch 63, and belt drive clutch 38, which had been turned on just before the original stopped, so as to restart the transportation of the original.

The switched-back original, when the copying machine body 203 (FIG. 1) stands ready for a copying operation after the lapse of a full resist time of the second resist roller clutch 110 by turning-on the second exposure resist sensor S8, turns on the second resist roller clutch 110. If the copying machine body 203 does not stand ready for a copying operation, all the originals at the upstream side of the third transport roller clutch 108 are stopped. As soon as the copying machine body 203 becomes ready to operate, the second resist roller clutch 110 is turned on, so that the transportation of the original at the upstream side can be restarted.

After the second resist roller clutch 110 is turned on, the second exposure timing sensor S9 is turned on, and the copying operation of the copying machine body is synchronized therewith. After the original has passed by the switchback roller inlet sensor S7, the switchback solenoid 113 is turned off, and the normal rotation of the switchback roller 112 is restored.

After the lapse of a predetermined time until the original completely passes through the second exposure unit 22 since it has passed by the second exposure timing sensor S9, the second resist roller clutch 110 is turned off to prepare resist operation of the next original. Also, the timing of turning-off the second resist roller clutch 110 is set, taking account of the influence of the clutch-off on the copy image.

The original enters from the lower return inlet 34 to the lowermost portion of the originals loaded on the paper stacker 11 via the paper discharge sensor S11 and paper discharge roller 42. As shown in FIGS. 14*b* and 6*a* through 6*h*, after the lapse of time $t_9$ until the original completely passes through the paper discharge roller 42 since it has passed by the paper discharge sensor S11, a one-turn solenoid 47 is turned on to press the fore end of original against the reference stoppers 31 by means of the delivery means while the discharged original is being lifted by the kick-up lever 45, thereby completely drawing out the original from the paper discharge guide 41.

The copying machine body 203 that is mounted onto the RDH 1 is described below: As shown in FIG. 1, the copying machine body 203 is provided with an exposure means 217 extending perpendicularly to the plane of FIG. 1 in the vicinity of the upper surface of the copying machine body 203. The exposure means 217 is transported in the directions of the arrows 255 and 321, the exposure means 217 including a light source 218 such as a halogen lamp or the like and a reflecting mirror 219. Light emitted from the light source 218 is selectively absorbed on the surface of the original corresponding to the original images. The reflected light from the original surface is guided by the reflecting mirrors 219, 222, 223 and 225 and a zoom lens 224 so as to form images at the exposure area 226*a* of a right cylindrical photosensitive body 226 having the axis perpendicular to the plane of FIG. 1.

Around the photosensitive body 226 is disposed an electrifying corona discharger 227 for uniformly electrifying the surface of the photosensitive body 226 before the surface of the photosensitive body 226 receives the reflected light from the original surface. The light corresponding to the original image is guided to the exposure area 226*a* so as to selectively deenergize the surface of the photosensitive body 226, resulting in electrostatic latent images. The electrostatic latent images are developed to toner by a developing unit 228 that is disposed downstream from the exposure area 226*a* in the rotating direction of the photosensitive body 226. The resulting toner images are then transferred to a copying paper Y at the transfer area 230 by a transferring corona discharger 229. The remaining toner on the surface of the photosensitive body 226 after the toner images are transferred is removed by a cleaning unit 231. The copying paper Y on which the toner images have been transferred at the transfer area 230 is transported to a fixing unit 257 by which the toner images are heated and fixed onto the copying paper Y.

A plurality of paper cassettes 232 containing therein recording papers of different sizes are charged into the copying machine body 203 from the lateral side thereof. A recording paper loaded on the uppermost side of any one of the paper cassettes 232 is guided one by one to a paper feed route 234 by a paper feed roller 233 that is selectively rotated by a driving means such as a motor. The afore-mentioned paper feed route 234 and a paper feed route 237 that is connected to an intermediate tray 236 are provided with transport rollers 238, respectively, which are rotatably driven by a motor. The transport rollers 238 guide the copying papers Y from the paper cassettes 232 and intermediate tray 236 to the vicinity of the transfer area 230 of the photosensitive body 226.

A resist roller 235 is provided at a transport route between the paper feed route 234 and the vicinity of the transfer area 230 of the photosensitive body 226, and a torque of the motor is selectively transmitted to the roller 235 by means of a clutch. Thus, the copying paper Y is transported in synchronism with the toner images formed at the surface of the photosensitive body 226.

At the lateral side of the copying machine body 203 is provided a paper discharge tray 240. The paper discharge tray 240 shifts perpendicularly to the plane of FIG. 1. For example, first, the paper discharge tray 240 shifts toward the front of the plane of FIG. 1, and then the discharge tray 240 shifts toward the rear of the plane of FIG. 1. In such a way, a plurality of copied papers Y with respect to one sheet of original can be loaded on the paper discharge tray 240 in the state that they have been assorted.

An inversion route 242 branches from a discharge route 241 for discharging a copied paper Y from the fixing unit 257 to the paper discharge tray 240, the inversion route 242 turning over the copied paper Y. The copied paper Y is discharged to the paper discharge tray 240 in the following three kinds of modes corresponding to each operation mode of the copying machine 202 set by an operator:

1. The copied paper Y directly passes through the discharge route 241 and is then discharged to the paper discharge tray 240.

2. The copied paper Y is guided from the discharge route 241 to the inversion route 242 and temporarily held in an intermediate tray 236 in order to make a copy on the other surface of the copied paper Y. The plurality of copied papers Y loaded on the intermediate tray 236 are sequentially guided to the vicinity of the transfer area 230 of the photosensitive body 226 from the lowermost copied paper Y by means of a paper feed roller 239 through the paper feed route 237. The copied paper Y on which toner images have been transferred is guided to the fixing unit 257, by which the toner images are heated and fixed onto the copied paper Y, and then passes through the discharge route 241 and is discharged to the paper discharge tray 240.

3. The copied paper Y is guided from the discharge route 241 to the inversion route 242 by which the copied paper Y is turned over, and then guided, again, to the discharge route 241 and discharged to the discharge tray 240.

The above-mentioned three modes are carried out with a construction of the inversion route 242, which comprises routes **242*a* and 242*b* branching from two positions at the discharge route 241, a route 242*c* connecting the route 242*a* with the route 242*b*, and a route 242*d* branching from the route 242*c* and extending toward the intermediate tray 236. Gate flappers are provided at the branches of the routes 241 and 242*a* to 242*d*, respectively, operate by driving solenoids, and automatically select the transport route of the copy paper Y depending upon a choice of the operator. At the above-mentioned branches are provided with inversion rollers 248 and 250**, which are inverted normally or reversely by a driving motor, thereby inverting the transport direction of the copying paper Y.

The copying machine 202 operates in a plurality of operation modes as discussed below. The exposure means 217 is stopped at the positions shown by the reference arrows 252 and 253 in connection with the first and second exposure units 22 and 21 respectively, or disposed at the position shown by the reference arrows 252 and 254.

The copying machine 202 repeatedly circulates plural sheets of original X, so that the following copying operations can be performed:

(A) Operation by which a plurality of one-sided copied sheets assorted into plural sets are obtained from a one-sided original;

(B) Operation by which a plurality of both-sided copied sheets sorted into plural sets are obtained from a one-sided original;

(C) Operation by which a plurality of one-sided copied sheets assorted into plural sets are obtained from a both-sided original; and (D) Operation by which a plurality of both-sided copied sheets assorted into plural sets are obtained from a both-sided original.

Figure 15:
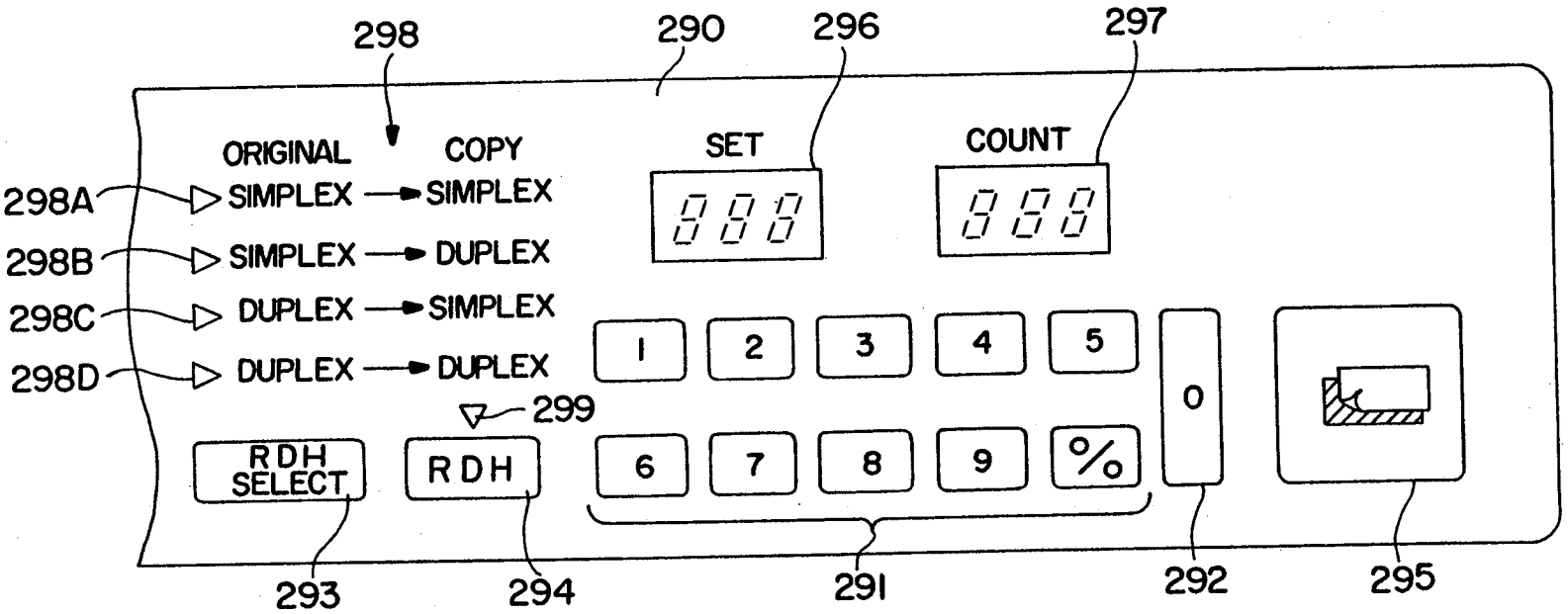
FIG. 15 is a plan view showing an operation panel of this invention.

FIG. 15 is a plan view showing a portion of a console panel 290 disposed on, for example, the upper surface of the copying machine body 203. The console panel 290 is provided with ten keys 291 for setting the number of copied sheets, a clear key 292, a copy mode selection key 293 for setting copy conditions, an RDH (recycling system automatic original feed) function key 294 for activating/not-activating the RDH 1 (FIG. 1), a print switch 295 for indicating the start of copying operation, a set number display 296 for displaying the set member of copied sheets set by the ten keys 291, a number display 297 for displaying the number of copied sheets, copy mode displays 298A through 298D for displaying copy modes selected by the copy mode selection key 293, and an RDH function mode display 299. The copy mode display 298 and RDH function mode display 299 include, for example, a light emitting diode, which is lit when each mode is selected.

The copy mode display 298 indicates the above-mentioned four copy modes of (A) through (D), respectively, when the one-sided copied sheets are obtained from the one-sided original (SIMPLEX→SIMPLEX), the both-sided copied sheets are obtained from the one-sided original (SIMPLEX→DUPLEX), one-sided copied sheets are obtained from the both-sided original, (DUPLEX→SIMPLEX), and the both-sided copied sheets are obtained from the both-sided original (DUPLEX→DUPLEX). Each time the copy mode selection key 293 is depressed, each copy mode is selected sequentially from above so that a light emitting diode (not shown) at each display 298 is lit. However, when the copy mode selection key 293 is depressed in a state that the copy mode display 298D is lit, the copy mode changes to SIMPLEX→SIMPLEX displayed at the copy mode display 298A.

The RDH 1 is activated in a state that the RDH function mode key 294 is depressed to light the RDH function mode display 299 and not-activated in a state that the same is depressed to switch off the display 299. In other words, when the operator places on the table 206 an original to be copied, such as a book, to obtain copied images thereof on a copying paper Y, the operator operates the RDH function key 294 to switch off the RDH function mode display 299. When the RDH 1 is used to transport the original X to be copied, the RDH function mode display 299 is kept to be lit.

When the RDH function is used, the operator operates the copy mode selection key 293 to set one of the copy modes as above-mentioned, and then operates the ten keys 291 to set a required number of copied sheets, at which time the set number of sheets is displayed at the set number display 296. Following the operation of the ten keys 291, when the print switch 295 is depressed, the RDH 1 and copying machine body 203 cooperate with each other to start the copying operation, at which time the number of copied sheets is successively displayed at the copy number display 297. In such a way, when a numeral value displayed at the copy number display 297 coincides with a numeral value displayed at the set number display 296, the operation of the copying machine 202 stops and the display of the set number display 296 is reset to "0". At this time, the display at the copy number display 297 is kept without being reset until the print switch 295 is depressed at the next time.

Although the above-mentioned embodiment discloses that copying sheets are used as sheets used herein, the invention is of course, applicable to sheets other than the copying sheets.

It is understood that various other modifications will be apparent to and can be readily made by those skilled in the art without departing from the scope and spirit of this invention. Accordingly, it is not intended that the scope of the claims appended hereto be limited to the description as set forth herein, but rather that the claims be construed as encompassing all the features of patentable novelty that reside in the present invention, including all features that would be treated as equivalents thereof by those skilled in the art to which this invention pertains.

What is claimed is:

1. A paper accommodation apparatus comprising:

a paper stacker in which papers are accommodated, the stacker including a first end and a second end;

reference stoppers that are disposed at the first end of said paper stacker;

a lower return inlet that is disposed at the second end of said paper stacker, said lower return inlet being provided with a paper discharge means for discharging paper into the paper stacker through the lower return inlet;

a paper discharge guide that is disposed at a position spaced from said reference stoppers at a distance smaller than the size of the papers to thereby hold above said lower return inlet the rear end of paper that has been discharged from said lower return inlet into said paper stacker by means of said paper discharge means;

delivery means by which the paper discharged from said lower return inlet to said paper stacker by means of said paper discharge means is deflected so as to be fed into said paper stacker beyond said paper discharge guide even after the fore end of the paper has come into contact with said reference stoppers; and kick-up means by which the rear end of the paper, the fore end of which has been restricted by said reference stoppers, is kicked up to be moved in the opposite direction to that of the paper delivery by the delivery means and held on said paper discharge guide.

2. A paper accommodation apparatus according to claim 1, wherein said delivery means is a semicircular roller that is projectable and retractable from the bottom surface area of said paper stacker in the vicinity of said reference stoppers.

3. A paper accommodation apparatus according to claim 1, wherein said kick-up means is a kick-up lever that is driven in synchronism with said delivery means and is projectable and retractable from the bottom surface of said paper stacker.

4. A paper accommodation apparatus according to claim 1 wherein said paper discharge means is a paper discharge roller and said paper discharge guide is an elastic piece that is in contact with said discharge roller, said elastic piece contacting said discharge roller at the paper discharge guide side before a point at which said paper discharge guide is tangent to said paper discharge roller.

* * * * *